US010420704B2

(12) United States Patent
Uetake et al.

(10) Patent No.: US 10,420,704 B2
(45) Date of Patent: Sep. 24, 2019

(54) PTP SHEET FOR PHARMACEUTICAL PACKAGING

(71) Applicant: Nipro Corporation, Osaka (JP)

(72) Inventors: Kazuaki Uetake, Osaka (JP); Takeshi Kodai, Osaka (JP)

(73) Assignee: Nipro Corporation, Osaka (JP)

( * ) Notice: Subject to any disclaimer, the term of this patent is extended or adjusted under 35 U.S.C. 154(b) by 478 days.

(21) Appl. No.: 14/895,533

(22) PCT Filed: Jun. 12, 2014

(86) PCT No.: PCT/JP2014/065614
§ 371 (c)(1),
(2) Date: Dec. 3, 2015

(87) PCT Pub. No.: WO2014/200064
PCT Pub. Date: Dec. 18, 2014

(65) Prior Publication Data

US 2016/0128903 A1 May 12, 2016

(30) Foreign Application Priority Data

Jun. 13, 2013 (JP) ..... 2013-124470
Jul. 2, 2013 (JP) ..... 2013-138658

(51) Int. Cl.
*B65B 1/04* (2006.01)
*A61J 1/03* (2006.01)
(Continued)

(52) U.S. Cl.
CPC ..... *A61J 1/035* (2013.01); *B65B 1/04* (2013.01); *B65B 5/103* (2013.01); *B65B 9/045* (2013.01);
(Continued)

(58) Field of Classification Search
CPC ..... B65D 75/327; B65D 2575/3254; B65D 2575/3281; A61J 1/035
(Continued)

(56) References Cited

U.S. PATENT DOCUMENTS 6,637,596 B1 * 10/2003 Ito ..... A61J 1/035 206/530
2006/0283758 A1 * 12/2006 Pasbrig ..... A61J 1/035 206/531
(Continued)

FOREIGN PATENT DOCUMENTS

JP 2006-206070 A 8/2006
JP 2007-60407 A 3/2007
(Continued)

OTHER PUBLICATIONS

International Search Report, International Application No. PCT/JP2014/065614, dated Jul. 15, 2014.

*Primary Examiner* — King M Chu
(74) *Attorney, Agent, or Firm* — Marshall, Gerstein & Borun LLP

(57) ABSTRACT

A PTP sheet for pharmaceutical packaging has a first sheet in which pockets each capable of housing a solid pharmaceutical are projected to the side of a first surface which is one of a back surface and a front surface and a second sheet which is pasted to a second surface opposite to the first surface in the first sheet and covers an opening of the pocket. The second sheet has a first region having mesh-shaped grooves having a first depth in a third surface opposite to the surface to be pasted to the second surface and a second region having mesh-shaped grooves having a second depth smaller than the first depth or not having a groove.

14 Claims, 13 Drawing Sheets

(51) Int. Cl.

| | |
|---|---|
| ***B65D 75/32*** | (2006.01) |
| ***B65B 41/10*** | (2006.01) |
| ***B65B 47/04*** | (2006.01) |
| ***B65B 51/02*** | (2006.01) |
| ***B65B 61/26*** | (2006.01) |
| ***B65B 47/02*** | (2006.01) |
| ***B65B 51/16*** | (2006.01) |
| ***B65B 61/28*** | (2006.01) |
| ***B65B 5/10*** | (2006.01) |
| ***B65B 9/04*** | (2006.01) |

(52) U.S. Cl.
CPC ..... *B65B 41/10* (2013.01); *B65B 47/02* (2013.01); *B65B 47/04* (2013.01); *B65B 51/02* (2013.01); *B65B 51/16* (2013.01); *B65B 61/26* (2013.01); *B65B 61/28* (2013.01); *B65D 75/327* (2013.01); *B65D 2203/02* (2013.01); *B65D 2203/06* (2013.01)

(58) Field of Classification Search
USPC ..... 206/531, 532
See application file for complete search history.

(56) References Cited

U.S. PATENT DOCUMENTS

| | | | | |
|---|---|---|---|---|
| 2007/0046466 | A1 | 3/2007 | Sakama et al. | |
| 2007/0095850 | A1* | 5/2007 | Meyer | A61J 1/035 221/2 |
| 2008/0230432 | A1* | 9/2008 | Bobbett | B65D 75/327 206/531 |
| 2008/0251411 | A1 | 10/2008 | Walker et al. | |
| 2010/0189942 | A1* | 7/2010 | Tamura | B32B 27/08 428/35.8 |

FOREIGN PATENT DOCUMENTS

| | | | |
|---|---|---|---|
| JP | 2007-69950 | A | 3/2007 |
| JP | 2008-68873 | A | 3/2008 |
| JP | 2009-509874 | A | 3/2009 |
| JP | 2009-82287 | A | 4/2009 |
| JP | 3152458 | U | 7/2009 |
| JP | 4545664 | B2 | 9/2010 |
| JP | 2012-192960 | A | 10/2012 |

* cited by examiner

[Fig1]
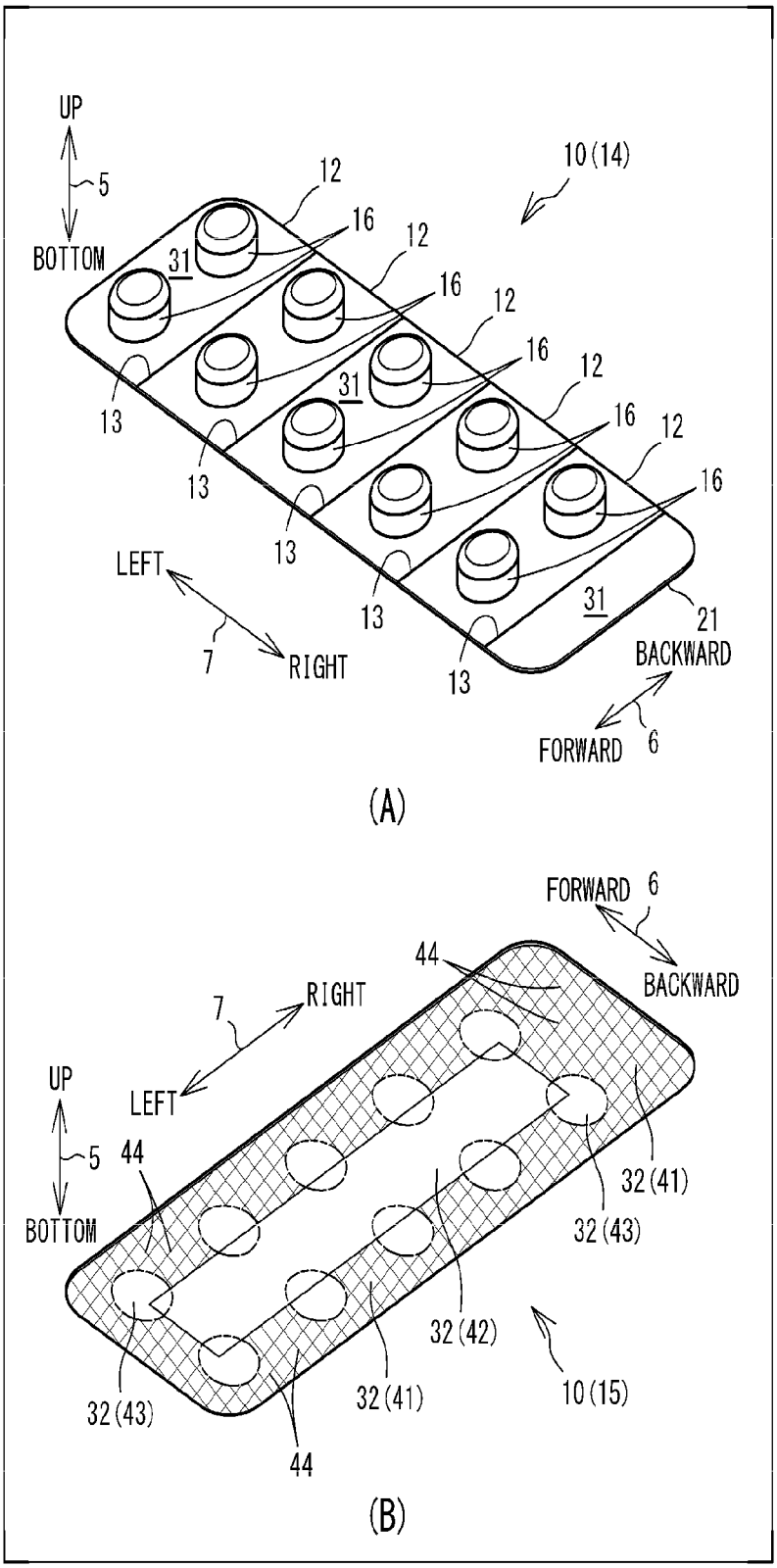

[Fig2]
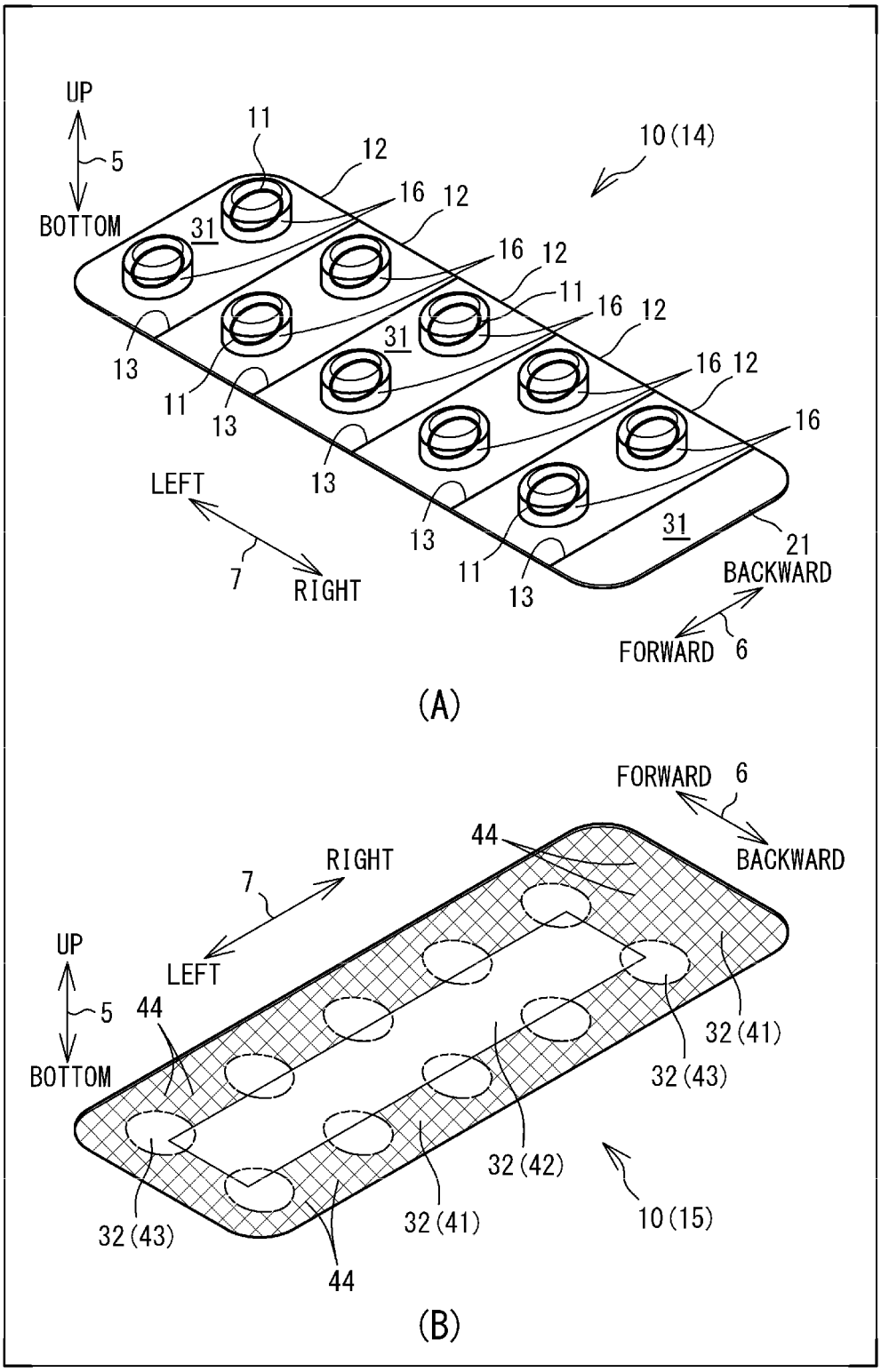

[Fig. 3]
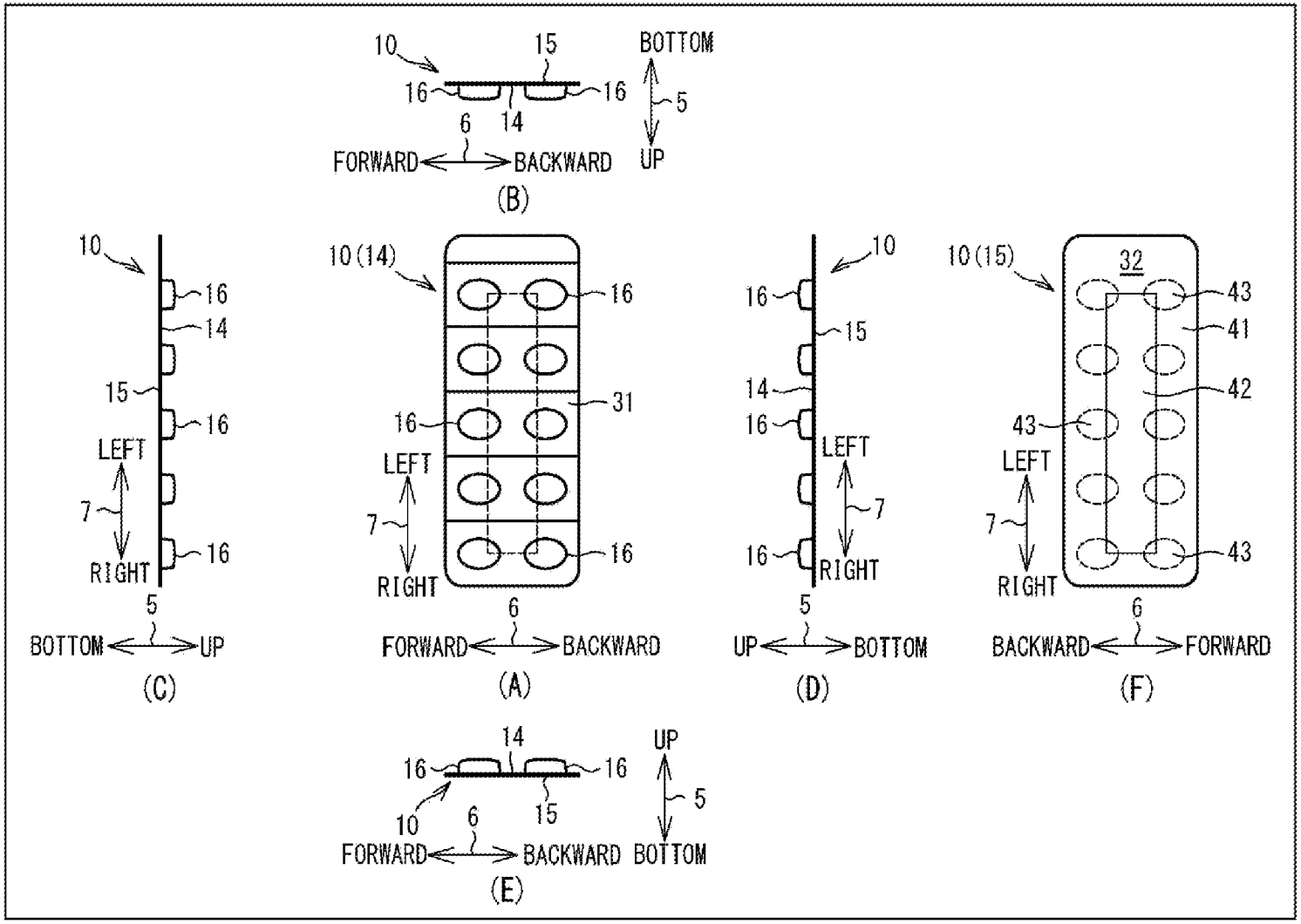

[Fig4]
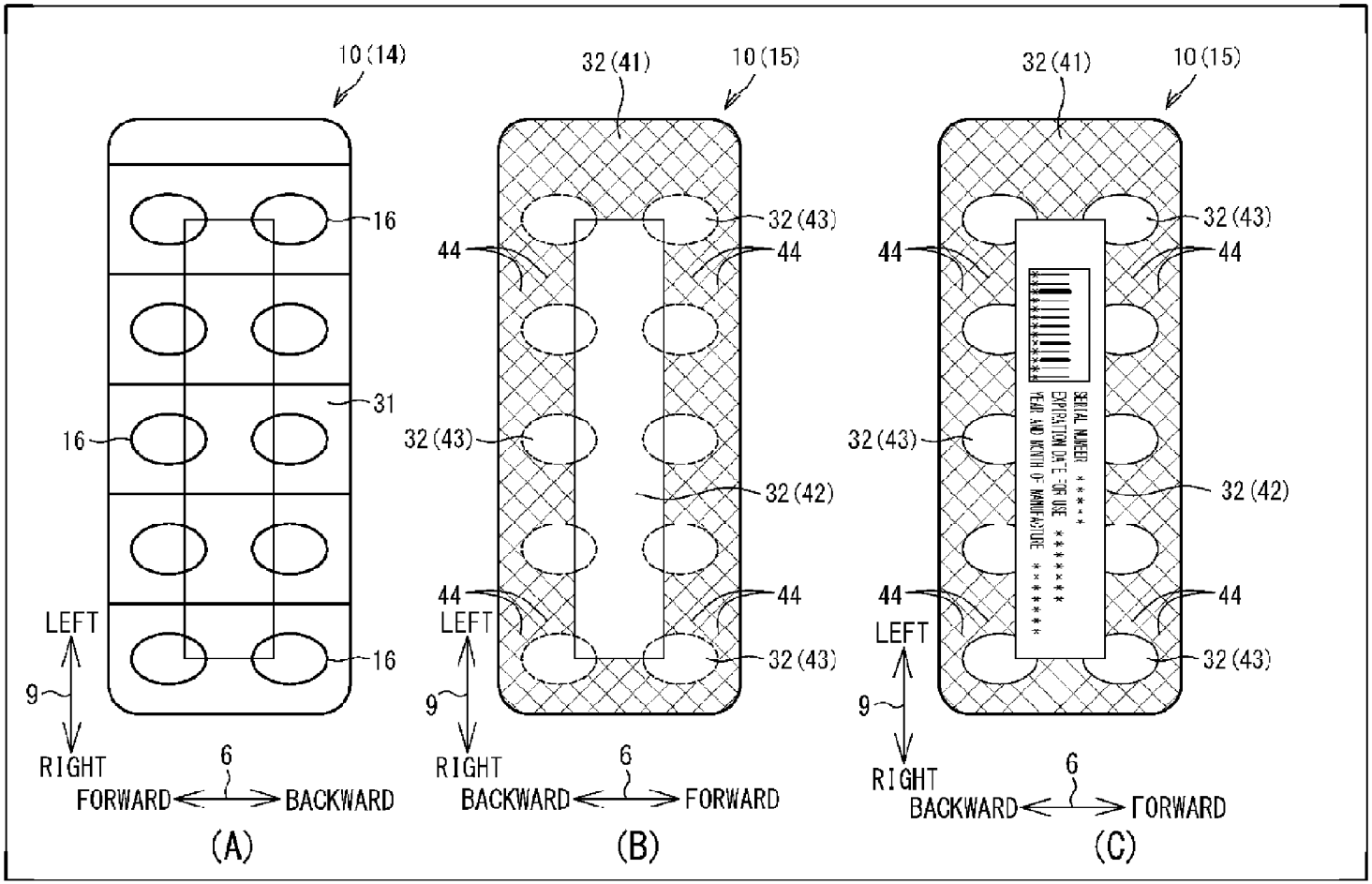

[Fig5]
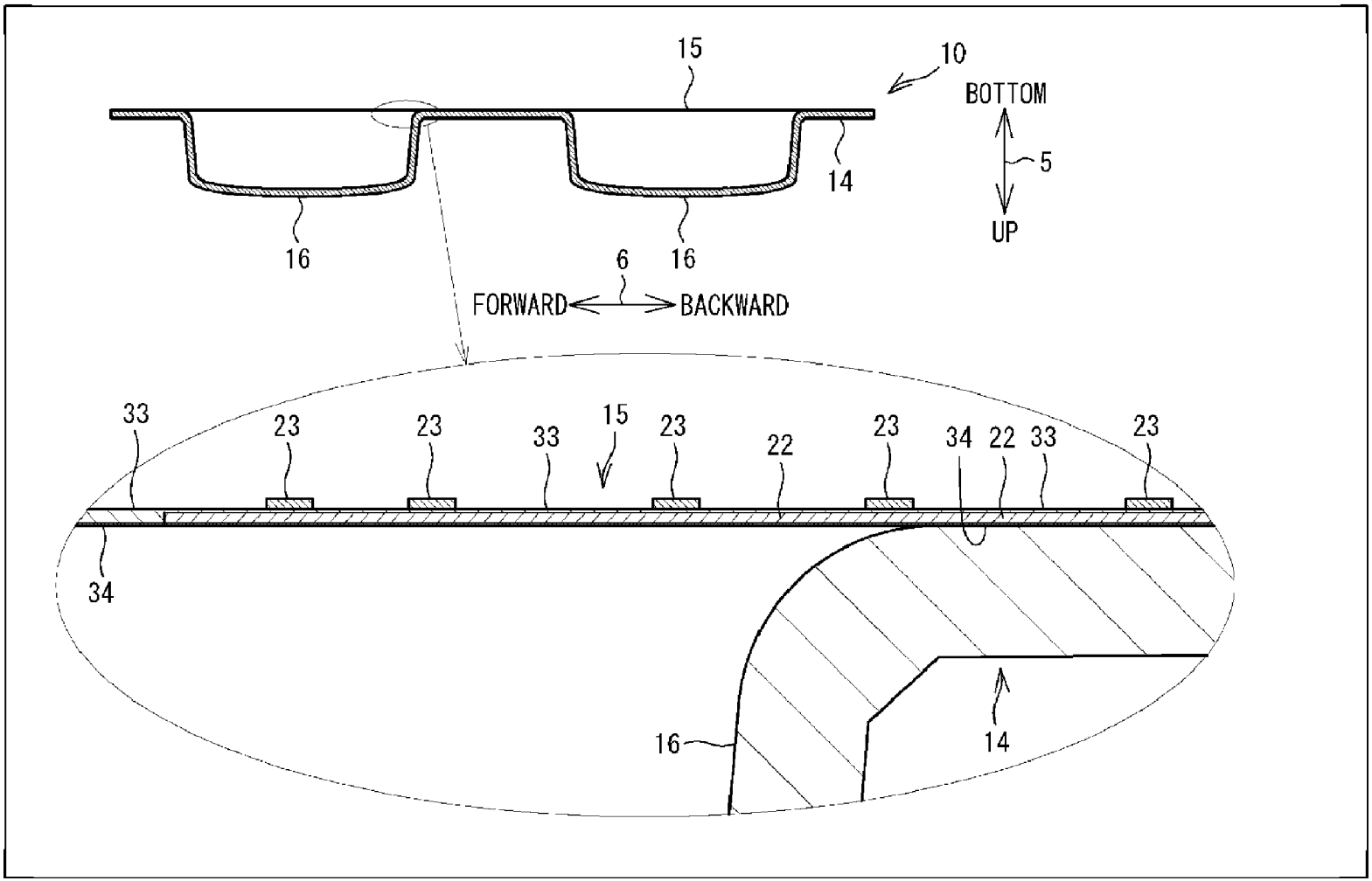

[Fig6]
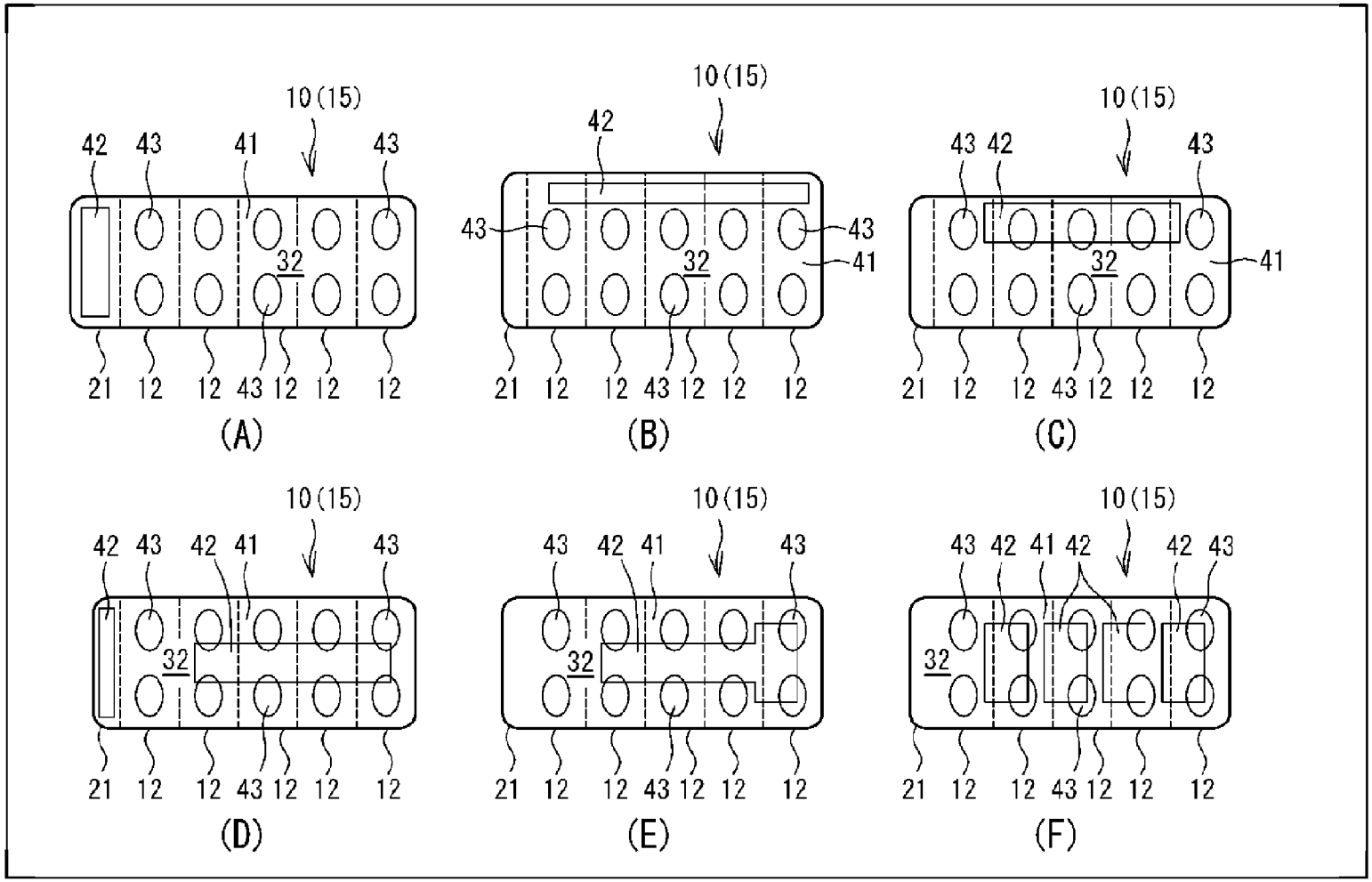

〔Fig7〕
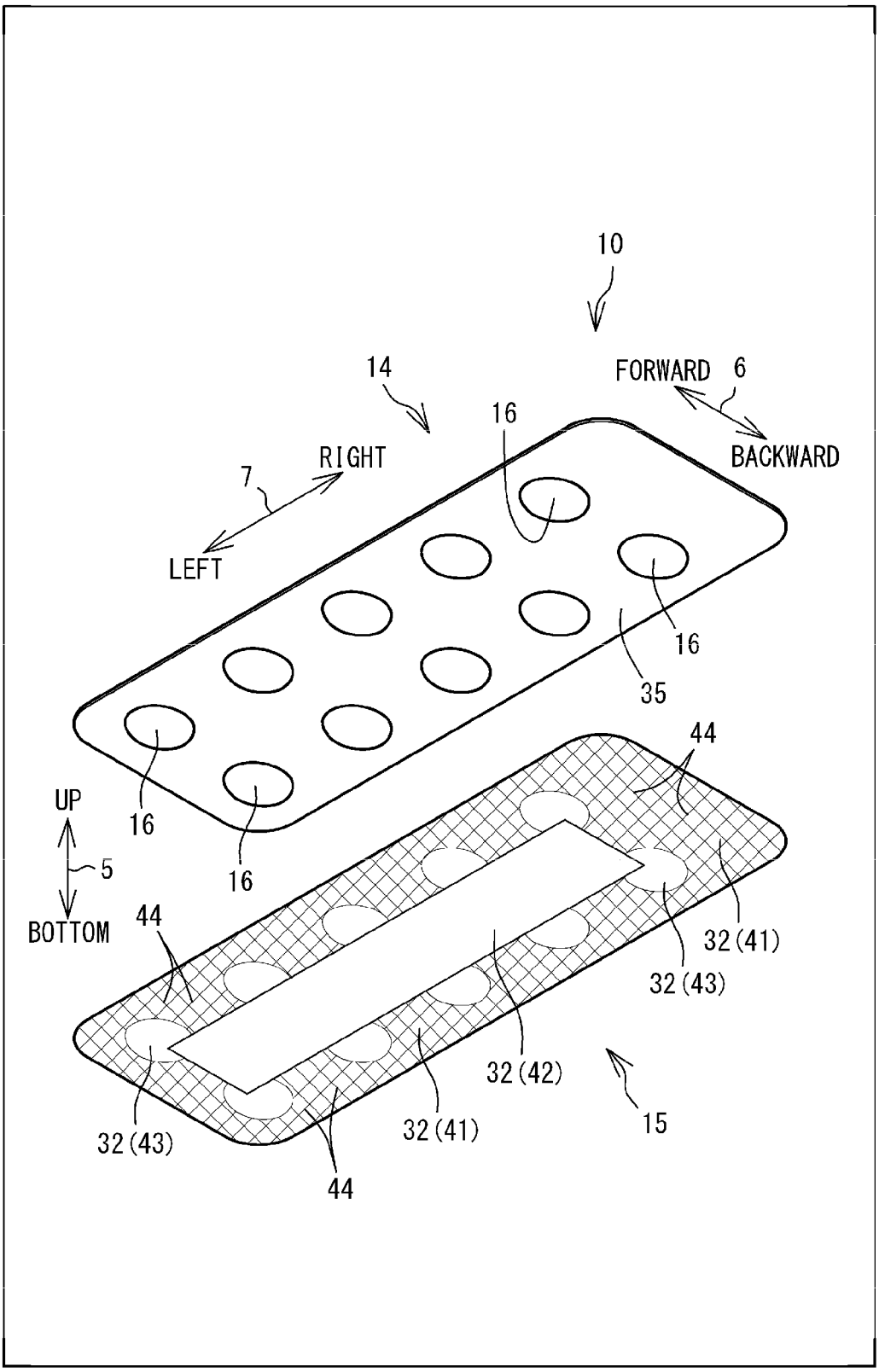

[Fig8]
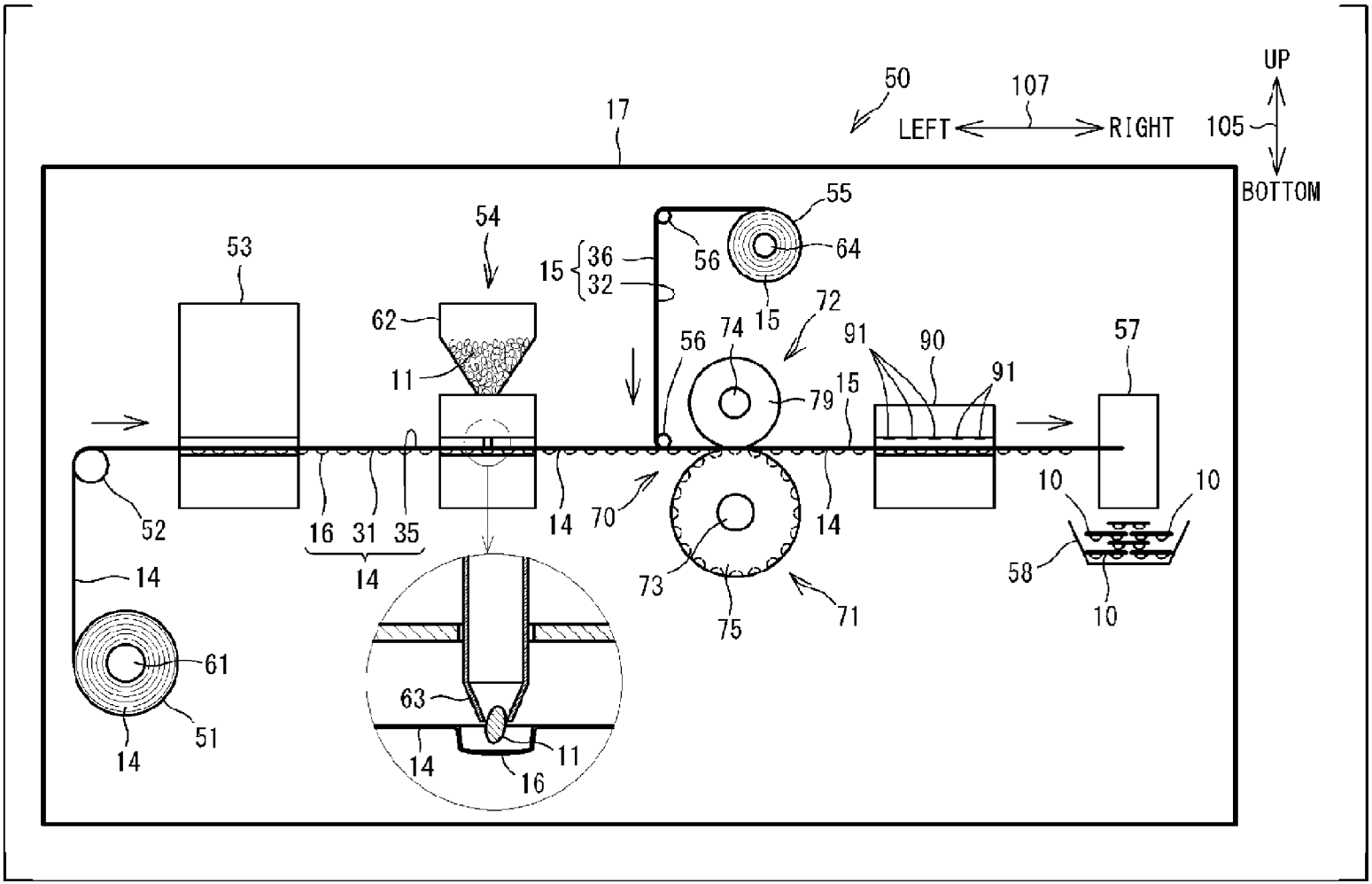

[Fig9]
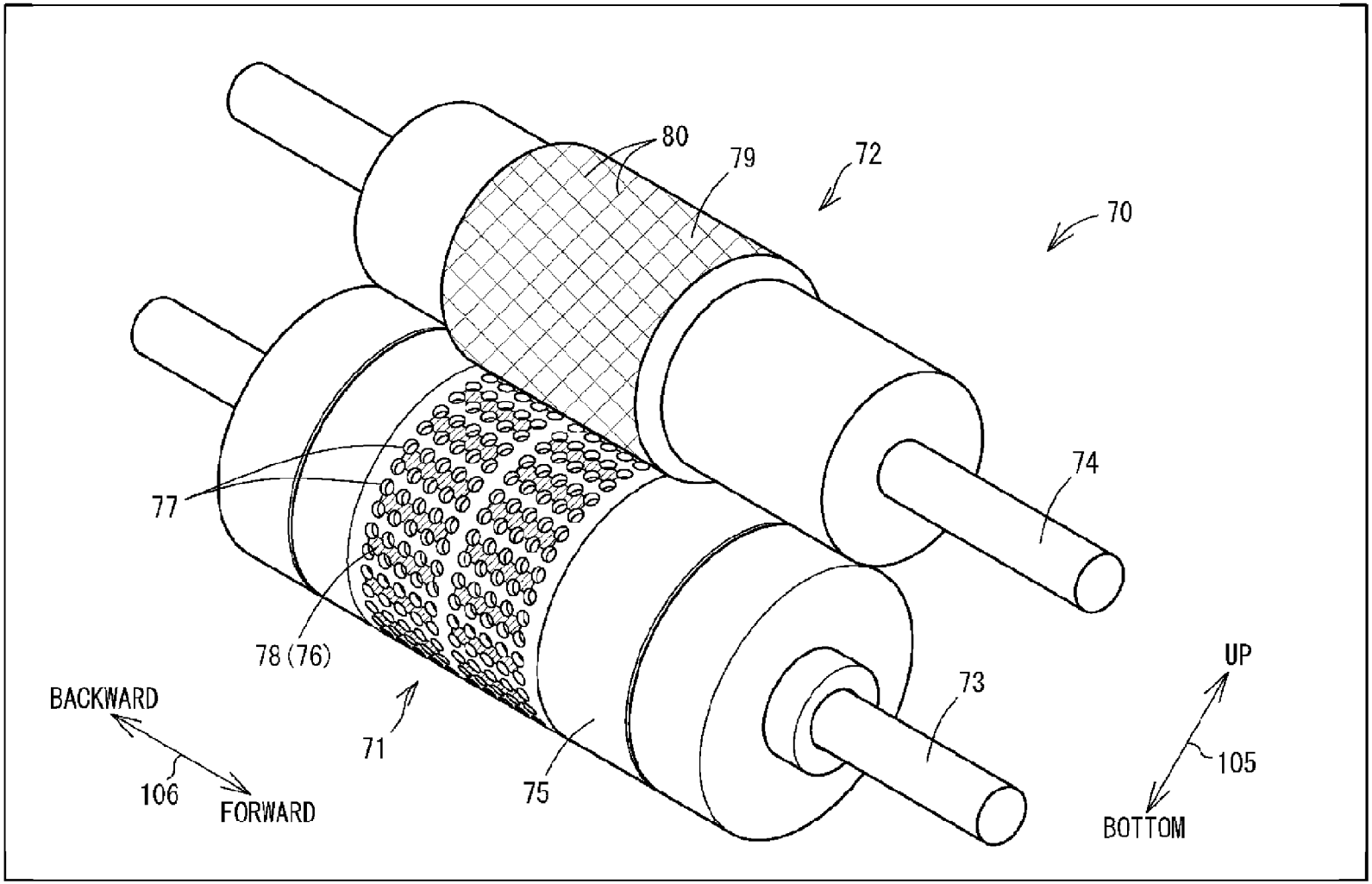

[Fig10]
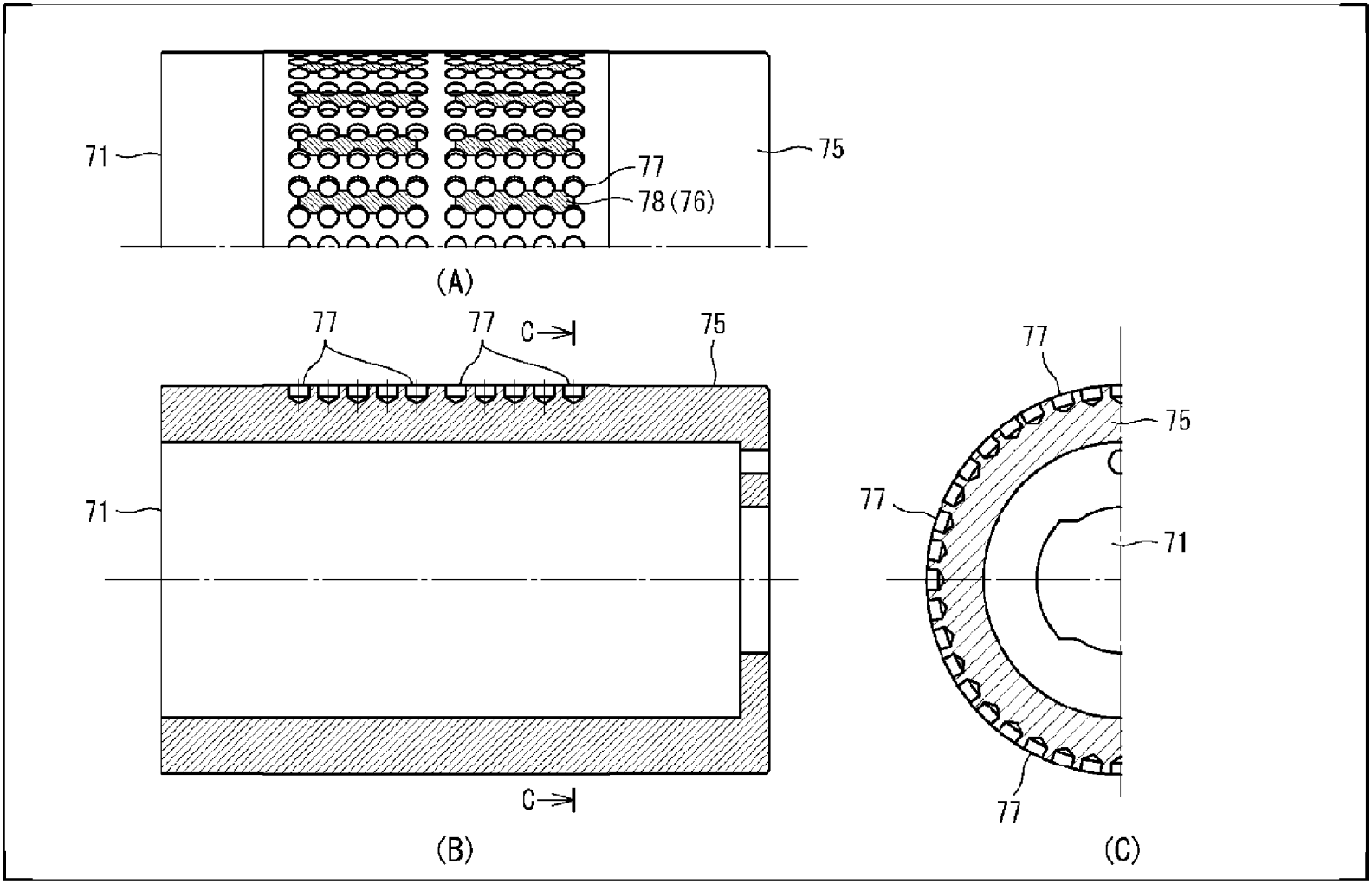

[Fig11]
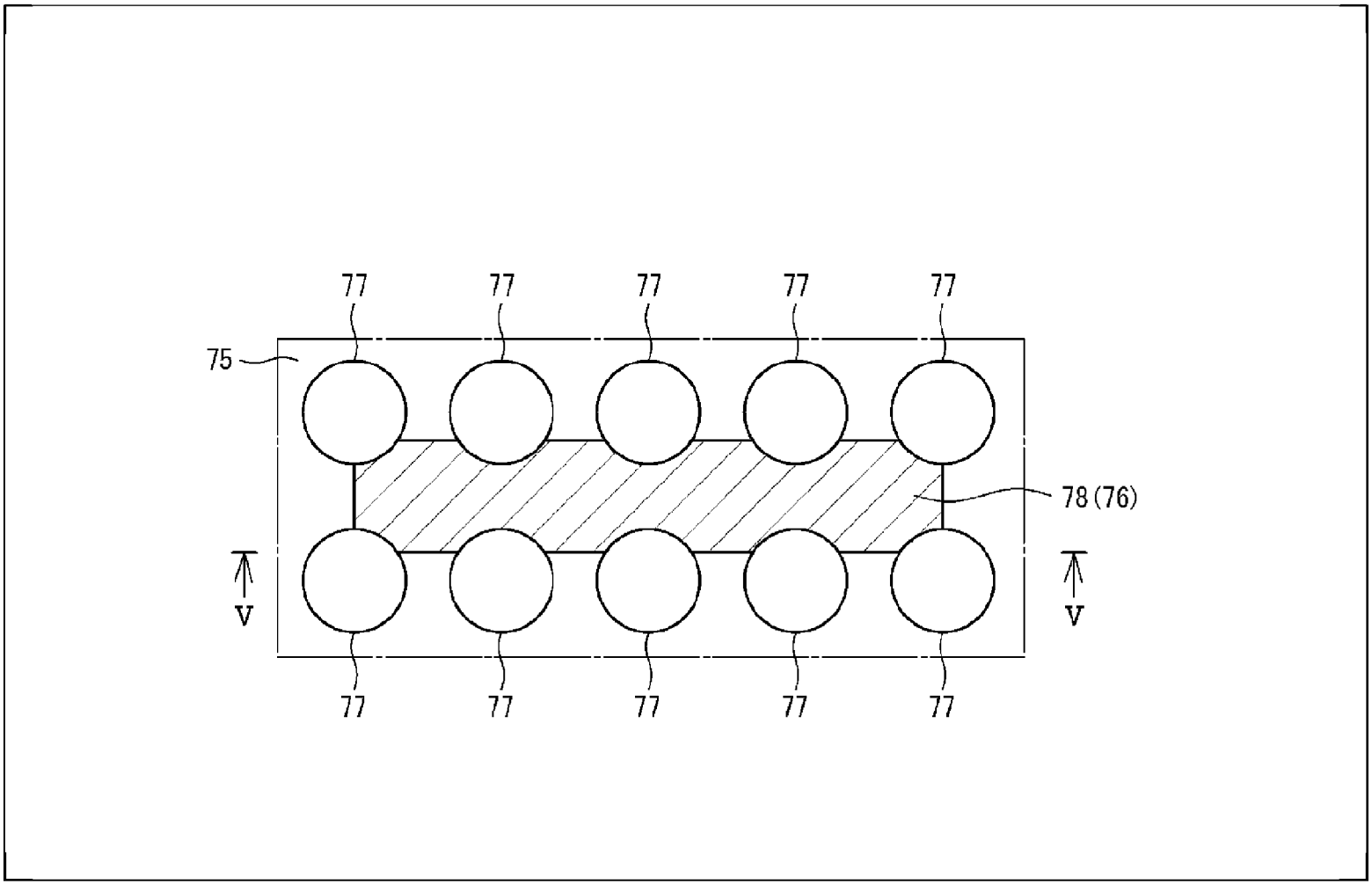

〔Fig12〕
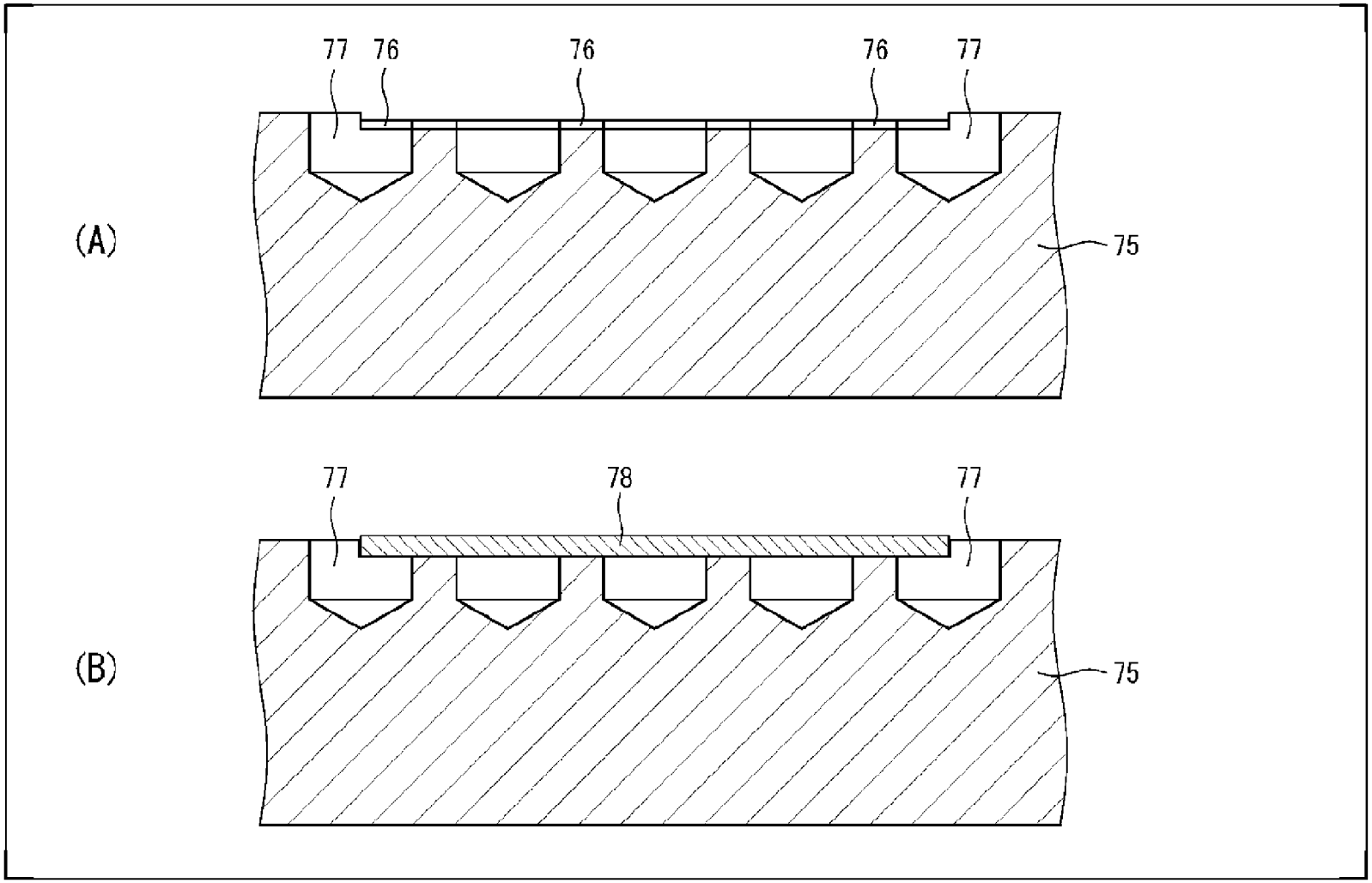

[Fig13]
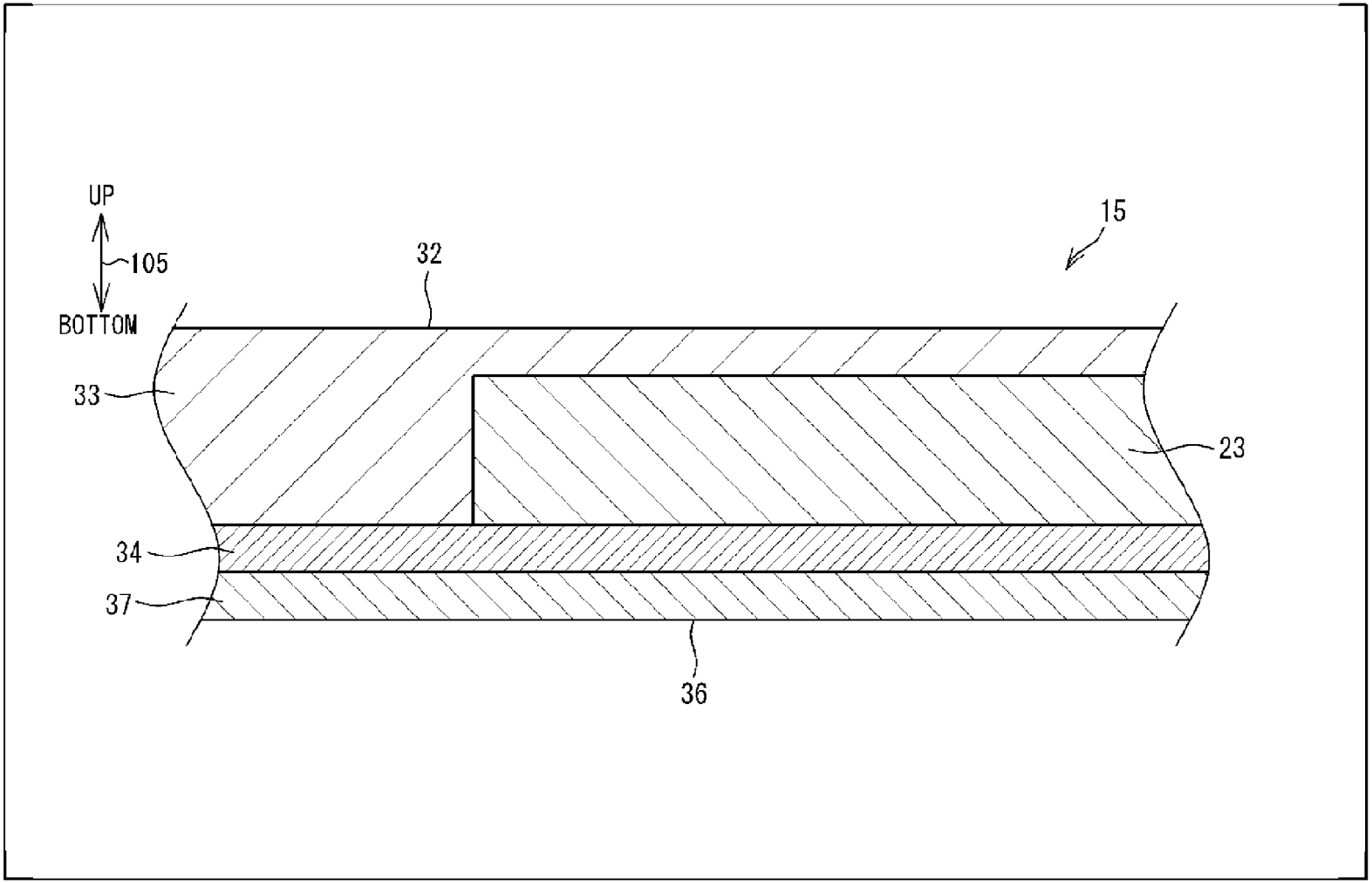

PTP SHEET FOR PHARMACEUTICAL PACKAGING

BACKGROUND OF THE INVENTION

Field of the Invention

The present invention relates to a PTP sheet for pharmaceutical packaging.

Description of the Related Art

PTP (Press Through Package) packaging has been widely used for packaging solid pharmaceuticals, such as tablets and capsule agents, in the field of packaging of pharmaceutical products. A PTP sheet for pharmaceutical packaging is a package obtained by molding pockets each housing a solid pharmaceutical in a resin film, loading the solid pharmaceutical in each pocket, and then pasting a sheet containing aluminum foil or the like to the resin film to seal the pockets. When the pocket is pressed by a user, the sheet containing aluminum foil or the like is broken by being pressed by the solid pharmaceutical loaded in the pocket, so that the solid pharmaceutical is taken out.

Heretofore, it has been demanded that a pharmacist prints information on a solid pharmaceutical, for example, the name of the solid pharmaceutical, the time when a patient takes the solid pharmaceutical, and the like, on the PTP sheet for pharmaceutical packaging. When the information on the solid pharmaceutical is printed on the PTP sheet for pharmaceutical packaging, a patient who confirms the information can take the solid pharmaceutical in a correct usage. Japanese Unexamined Patent Application Publication No. 2012-192960 discloses a PTP sheet for pharmaceutical packaging provided with an information printing layer for printing the name, the usage, and the like of a solid pharmaceutical.

Heretofore, mesh-shaped grooves are formed for preventing slipping and the like in a surface opposite to a surface which is to be pasted to the resin film in the sheet containing aluminum foil or the like of the PTP sheet for pharmaceutical packaging.

The PTP sheet for pharmaceutical packaging as described above is manufactured by a manufacturing apparatus described in Japanese Unexamined Patent Application Publication No. 2012-192960. The manufacturing apparatus has a film receiving roll 19 and a heating roll 20. A first sheet in which solid pharmaceuticals are loaded and a second sheet containing aluminum foil or the like pass through a space between the rolls 19 and 20 in a thermal pressure-contact state, so that the second sheet is pasted to the first sheet under pressure, whereby a PTP sheet for pharmaceutical packaging in which the solid pharmaceuticals are loaded is manufactured.

Heretofore, mesh-shaped grooves are formed for preventing slipping and the like in a surface opposite to a surface which is to be pasted to the resin film in the sheet containing aluminum foil of the PTP sheet for pharmaceutical packaging. When the PTP sheet for pharmaceutical packaging in which the mesh-shaped grooves are formed is manufactured by the manufacturing apparatus described in Japanese Unexamined Patent Application Publication No. 2012-192960, mesh-shaped convex portions may be provided in the surface of the heating roller 20.

PRIOR ART DOCUMENTS

Patent Literature

Patent Document 1: Japanese Unexamined Patent Application Publication No. 2012-192960

Patent Document 2: Japanese Patent No. 4545664

SUMMARY OF THE INVENTION

Problems to be Solved by the Invention

However, when the information on the solid pharmaceutical is printed as a code which can be optically read on the opposite surface described above, the following problems arise. More specifically, since the mesh-shaped grooves are formed in the opposite surface, there is a possibility that the information on the solid pharmaceutical printed on the opposite surface is partially deleted or the shape when the printed information is viewed from the front looks distorted. Even in that case, when the information on the solid pharmaceutical are characters or figures, a user can read the information unless the deletion degree or the distortion degree is severe, e.g., one character is entirely omitted.

However, in the case where the information on the solid pharmaceutical is a code, even when the information is slightly deleted or distorted, there is a possibility that the code cannot be read by a scan or, even when the code can be read, two or more times of scanning or scanning at different positions are required for the reading of the code.

Moreover, the same problem arises also in the case where information on a solid pharmaceutical is printed as a code which can be optically read, such as a bar code, in a PTP sheet for pharmaceutical packaging manufactured in such a manner that mesh-shaped grooves are formed by a manufacturing apparatus described in Japanese Patent (Translation of PCT Application) No. 4545664.

The present invention has been made in view of the above-described circumstances. It is an object of the present invention to provide a PTP sheet for pharmaceutical packaging which can correctly and quickly read information on a solid pharmaceutical printed as a code which can be optically read.

It is another object of the present invention to provide a means capable of manufacturing a PTP sheet for pharmaceutical packaging from which information on a solid pharmaceutical printed as a code, which can be optically read, can be correctly and quickly read.

Means of Solving the Problems (1) A PTP sheet for pharmaceutical packaging according to the present invention has a first sheet in which pockets each capable of housing a solid pharmaceutical are projected to the side of a first surface which is one of a back surface and a front surface and a second sheet which is pasted to a second surface opposite to the first surface in the first sheet and covers an opening of the pocket. The second sheet has a first region having mesh-shaped grooves having a first depth in a third surface opposite to the surface to be pasted to the second surface and a second region having mesh-shaped grooves having a second depth smaller than the first depth or having no grooves.

According to this configuration, the grooves of the second region are shallower than the grooves of the first region or no grooves are formed in the second region. Therefore, characters, figures, a code which can be optically read, and the like are printed in the second region, the deletion or the distortion of the printed code and the like can be reduced.

(2) The entire edge of the third surface is the first region.

When the grooves of the second region are made shallow by setting the pressure to the second region to be smaller than the pressure to the first region in the case where the PTP sheet for pharmaceutical packaging is produced by pasting the first sheet and the second sheet to each other under pressure, a possibility becomes high that a gap is formed between the second sheet and the first sheet in the second region due to the fact that the pressure is insufficient. In this case, it is supposed that the edge of the third surface is the second region, there is a possibility that liquid or the like enters the space in the pocket through the gap generated on the edge of the third surface. Thus, in this configuration, the entire edge of the third surface is the first region where the gap is hard to be formed due to the fact that the pressure is high. Thus, a possibility that liquid or the like enters the space in the pocket from the edge of the third surface can be made low.

(3) The second region is overlapped with the third region at least a part of which is a region corresponding to the pocket in the third surface.

According to this configuration, there is no necessity of completely separately providing the second region and the third region. Thus, the area of the third surface can be made small. As a result, the PTP sheet for pharmaceutical packaging can be made small.

(4) The overlapped area of the second region and the third region corresponding to one pocket is equal to or less than half of the area of the third region.

When the second region is a region where a predetermined substance is applied to the third surface, the thickness in the second region becomes larger than the other region in the second region. In this case, when the overlapped area of the second region and the third region becomes large, the third region of the second sheet is hard to be broken, which makes it difficult to take out the pharmaceutical from the pocket. Thus, in this configuration, the overlapped area of the second region and the third region is suppressed to be equal to or less than half of the area of the third region. Therefore, the difficulty of breaking the third region of the second sheet can be suppressed.

(5) The main component of the first sheet may be a thermoplastic resin.

(6) The second sheet may be a laminated sheet having an aluminum layer.

(7) The main component of the first sheet is a thermoplastic resin. The second sheet is a laminated sheet having an aluminum layer. In the second region, the length along the longitudinal direction of the third surface is longer than the length along the short direction of the third surface.

Although the first sheet formed with resin is contracted in the short direction in a manufacturing process in which the pockets are formed, the second sheet having the aluminum layer does not contract. Therefore, the PTP sheet for pharmaceutical packaging tends to be curved in the short direction with the lapse of time. When characters, figures, a code which can be optically read, and the like are printed in the second region of the PTP sheet for pharmaceutical packaging which is curved in the short direction, the printed code and the like are deleted or distorted. Then, according to this configuration, the second region has a length along the longitudinal direction of the third surface which is hard to be curved longer than the length along the short direction of the third surface which is likely to be curved. Thus, the deletion or the distortion of the code and the like described above can be suppressed.

(8) The thickness of the first sheet may be in the range of 200 [μm] to 350 [μm].

Due to the fact the thickness of the first sheet is in the range mentioned above, the airtightness of the pocket can be secured without excessively thickening the first sheet.

(9) The thickness of the second sheet may be in the range of 20 [μm] to 25 [μm].

Due to the fact that the thickness of the second sheet is in the range mentioned above, the airtightness of the pocket whose opening is covered with the second sheet is secured and also the ease of breaking the second sheet in taking out the solid pharmaceutical from the pocket can be secured.

(10) The second depth may be 100 [μm] or less.

According to this configuration, the deletion or the distortion of the characters, the figures, the code which can be optically read, and the like printed in the second region can be reduced.

(11) A material to be recorded on which ink droplets can land adheres to the second region.

According to this configuration, a region where characters, figures, a code which can be optically read, and the like can be printed can be easily formed on the third surface side of the second sheet by the material to be recorded.

(12) The material to be recorded is white.

According to this configuration, the contrast between the characters, the figures, the code which can be optically read, and the like to be printed in the second region and the background of the second region becomes high, a possibility that the code and the like are erroneously read can be made low.

(13) The material to be recorded may be a coating at least containing titanium oxide.

(14) In the second region, the code which can be optically read may be printed.

(15) An apparatus for manufacturing a PTP sheet for pharmaceutical packaging according to the present invention has a first conveyance unit conveying a first beltlike sheet, a pocket formation unit forming pockets which are projected to the side of a first surface, which is one of a back surface and a front surface of the first sheet to be conveyed by the first conveyance unit, and the pockets which each can house a solid pharmaceutical, a pharmaceutical loading unit loading the solid pharmaceutical in each pocket formed by the pocket formation unit, a second conveyance unit conveying a second sheet which has a beltlike shape and is thinner than the first sheet and in which an adhesive agent is applied to a fourth surface which is one of a back surface and a front surface, a pasting unit which has a first roller having first concave portions and second concave portions in which the pockets are housed in the surface and abutting on the first surface of the first sheet to be conveyed and a heated second roller having mesh-shaped convex portions in the surface and abutting on a third surface opposite to the fourth surface of the second sheet to be conveyed and the pasting unit which melts the adhesive agent with the heat of the second roller by holding the first sheet and the second sheet with the first roller and the second roller to paste the second surface opposite to the first surface of the first sheet and the fourth surface of the second sheet to each other, and a printing unit printing an image on the third surface of the second sheet to be conveyed by the second conveyance unit. In the first concave portion, an elastic member softer than the first roller and having a thickness larger than the depth of the first concave portion is embedded. The printing unit prints an image on a region held between the elastic member and the second roller of the third surface in pasting by the pasting unit.

When the pasting unit pastes the first sheet and the second sheet to each other, the mesh-shaped grooves are formed in the third surface of the second sheet by being pressed by the convex portions of the second roller. In this operation, since the elastic member softer than the first roller is embedded in the first concave portion, the pressing force of the second roller to the region held between the elastic member and the second roller of the third surface of the second sheet is reduced. Thus, the grooves formed in the region become shallower than grooves formed in a region other than the region or no grooves are formed. As a result, the deletion or the distortion of the image printed by the printing unit in the region where the shallow grooves are formed or no grooves are formed can be reduced.

(16) The first concave portions of the first roller are provided on the inner side than ends of the second sheet abutting on the second roller in the axial direction of the second roller.

When the first concave portions are provided at positions corresponding to the ends of the second sheet in the axial direction of the second roller, the pressing force by the second roller to the ends of the first sheet is reduced. As a result, in the manufactured PTP sheet for pharmaceutical packaging, a gap is formed between the first sheet and the second sheet at the ends, so that there is a possibility that liquid or the like enters the space in the pocket from the ends. Thus, in this configuration, the first concave portions are provided at positions corresponding to the inner side relative to the ends of the second sheet in the axial direction of the second roller. Therefore, in the manufactured PTP sheet for pharmaceutical packaging, since a possibility that a gap is formed between the first sheet and the second sheet at the ends becomes low, a possibility that liquid or the like enters the space in the pocket from the ends can be made low.

(17) On the surface of the first roller, the first concave portions and the second concave portions are overlapped with each other in at least one part.

According to this configuration, in the third surface of the PTP sheet for pharmaceutical packaging manufactured by the manufacturing apparatus, a region where an image is to be printed and a region corresponding to the space where a solid pharmaceutical is loaded can be shared. Thus, the PTP sheet for pharmaceutical packaging can be made small.

(18) On the surface of the first roller, the overlapped area of the first concave portion and one second concave portion is equal to or less than half of the area of the second concave portion.

When the PTP sheet for pharmaceutical packaging is manufactured in such a manner that the first concave portions and the second concave portions are overlapped with each other by the manufacturing apparatus in the case where the region where the image is to be printed in the third surface of the second sheet is a region where a predetermined substance is applied to the third surface, the thickness of the region is increased by the application of the predetermined substance in the PTP sheet for pharmaceutical packaging. Therefore, the second sheet is hard to be broken in taking out the solid pharmaceutical. Thus, in this configuration, the overlapped area of the first concave portion and one second concave portion is suppressed to be equal to or less than half of the area of the second concave portion on the surface of the first roller. Therefore, in the PTP sheet for pharmaceutical packaging manufactured by the manufacturing apparatus, the difficulty of breaking the second sheet can be suppressed as described above.

(19) The printing unit may record an image on the third surface of the second sheet before being pasted to the first sheet.

(20) The printing unit records an image on the third surface of the second sheet after being pasted to the first sheet.

According to this configuration, since the third surface after the image is printed is not pressed by the second roller, a possibility that the image may be deleted or distorted can be made low.

(21) The depth of the first concave portion may be in the range of 0.5 [mm] to 1.5 [mm].

According to this configuration, the elastic member can be attached to the first roller in a stabilized state.

(22) The elastic member may be silicon rubber.

(23) The printing unit may print an image on the third surface by discharging ink droplets to the third surface of the second sheet.

(24) The printing unit may discharge an ultraviolet curing type ink droplet.

According to this configuration, since ink landing on the third surface is quickly dried by the application of ultraviolet rays, a possibility that blurring of the ink due to accidental contact with the ink or the like occurs can be made low.

(25) A material to be recorded adheres to a part of the third surface of the second sheet and the first concave portion may be provided at a position where the elastic member holds the material to be recorded with the second roller.

(26) The present invention can be regarded as a method for manufacturing a PTP sheet for pharmaceutical packaging having a first conveyance process of conveying a first beltlike sheet, a pocket formation process of forming pockets which are projected to the side of a first surface, which is one of a back surface and a front surface of the first sheet to be conveyed, and the pockets which each can house a solid pharmaceutical, a pharmaceutical loading process of loading the solid pharmaceutical in each pocket formed in the pocket formation process, a second conveyance process of conveying a second sheet which has a beltlike shape and is thinner than the first sheet and in which an adhesive agent is applied to a fourth surface which is one of a back surface and a front surface, a pasting process of holding the first sheet in which the pharmaceuticals are loaded in the pharmaceutical loading process and the second sheet by a first roller having first concave portions, in which an elastic member softer than the first roller and having a thickness larger than the depth of the first concave portion is embedded, and second concave portions in which the pockets are housed in the surface and abutting on the first surface of the first sheet to be conveyed and a heated second roller having mesh-shaped convex portions in the surface and abutting on a third surface opposite to the fourth surface of the second sheet to be conveyed to melt the adhesive agent with the heat of the second roller to paste the third surface opposite to the first surface of the first sheet and the fourth surface of the second sheet, and a printing process of printing an image in a region held between the elastic member and the second roller of the third surface of the second sheet to be conveyed in pasting in the pasting unit.

Effects of the Invention

According to the PTP sheet for pharmaceutical packaging of the present invention, the information on the solid pharmaceutical printed as a code which can be optically read can be correctly and quickly read.

Moreover, according to the present invention, a PTP sheet for pharmaceutical packaging from which the information on the solid pharmaceutical printed as a code which can be optically read can be correctly and quickly read can be manufactured.

BRIEF DESCRIPTION OF THE DRAWINGS

FIGS. 1A and 1B are perspective views of the appearance of a PTP sheet 10 in which a solid pharmaceutical 11 is not housed, FIG. 1A illustrates a state as viewed from obliquely upward, and FIG. 1B illustrates a state as viewed from obliquely downward.

FIGS. 2A and 2B are perspective views of the appearance of the PTP sheet 10 in which the solid pharmaceuticals 11 are housed, FIG. 2A illustrates a state as viewed from obliquely upward, and FIG. 2B illustrates a state as viewed from obliquely downward.

FIGS. 3A to 3F are views illustrating the PTP sheet 10 by a third angle projection method.

FIG. 4A is a front view of the PTP sheet 10 in which the solid pharmaceutical 11 is not housed, FIG. 4B is a rear view of the PTP sheet 10 on which information on the solid pharmaceutical 11 is not printed in a second region 42, and FIG. 4C is a rear view of the PTP sheet 10 on which the information on the solid pharmaceutical 11 is printed in the second region 42.

FIG. 5 is a vertical cross sectional view schematically illustrating a part of the PTP sheet 10.

FIGS. 6A to 6F are rear views of the PTP sheet 10.

FIG. 7 is a disassembled perspective view in which the PTP sheet 10 in FIG. 1B is disassembled into a first sheet 14 and a second sheet 15.

FIG. 8 is a vertical cross sectional view schematically illustrating a manufacturing apparatus 50.

FIG. 9 is a perspective view schematically illustrating a pasting unit 70.

FIG. 10A is a perspective view schematically illustrating a part of a roller portion 75 of a first roller 71, FIG. 10B is a cross sectional view schematically illustrating a part of the first roller 71, and FIG. 10C is a cross sectional view along the C-C line of FIG. 10B.

FIG. 11 is a plan view schematically illustrating second concave portions 77 and an elastic member 78.

FIGS. 12A and 12B are cross sectional views along the V-V line of FIG. 11, FIG. 12A illustrates a state where the elastic member 78 is not embedded, and FIG. 12B illustrates a state where the elastic member 78 is embedded.

FIG. 13 is a vertical cross sectional view schematically illustrating a part of the PTP sheet 10.

DESCRIPTION OF THE PREFERRED EMBODIMENT

Hereinafter, an embodiment of the present invention is described with reference to the drawings as appropriate. The embodiment described below is a merely example of the present invention. It is a matter of course that the embodiment of the present invention can be altered as appropriate in the range where the scope of the present invention is not altered. In the following description, a vertical direction 5 is defined on the basis of a state where the PTP sheet 10 is disposed with the surface, in which pockets 16 are provided, facing upward, the short direction on the surface is defined as a forward and backward direction 6, and a direction perpendicular to the vertical direction 5 and the forward and backward direction 6 is defined as a right and left direction 7.

[Schematic Configuration of PTP Sheet 10]

As illustrated in FIGS. 1A and 1B, the PTP sheet (an example of the PTP sheet for pharmaceutical packaging of the present invention) is an approximately rectangular sheet as viewed in plan. The shape of the PTP sheet 10 is not limited to the rectangular shape. For example, the PTP sheet 10 may have a circular shape as viewed in plan.

As illustrated in FIGS. 2A and 2B, the solid pharmaceuticals 11, such as tablets and capsule agents, are sealed in the pockets 16 described later in the PTP sheet 10. The dimension in the forward and backward direction 6 and the right and left direction 7 of the PTP sheet 10 can be determined as appropriate based on the number and the size of the solid pharmaceuticals 11 to be sealed in one PTP sheet 10.

The PTP sheet 10 is configured so that five cells 12, which are divisions each sealing two solid pharmaceuticals 11, are arranged in the right and left direction 7. In one PTP sheet 10 illustrated in FIGS. 2A and 2B, ten solid pharmaceuticals 11 in total are sealed. The number of the solid pharmaceuticals 11 to be sealed in the PTP sheet 10 is not limited to ten pieces.

On the right side of the cell 12 on the rightmost side, a cell 21 in which the solid pharmaceutical 11 is not sealed is provided. The cell 21 is used as a region for holding the PTP sheet 10 by a user, a region for writing down or printing information on the solid pharmaceutical 11, or the like. The position where the cell 21 is provided is not limited to the right side of the cell 12 on the rightmost side and may be located on the left side of the cell 12 on the leftmost side or may be located between the two cells 12.

Slits 13 are formed on the boundary between the cells 12 and on the boundary of the cells 12 and 21. The PTP sheet 10 is separated by being bent along the slit 13 by the hands of a pharmacist or a patient to be able to be divided into the single cells 12 and 21. The dimensions in the forward and backward direction 6 and the right and left direction 7 of the cells 12 can be determined as appropriate based on the number and the size of the solid pharmaceuticals 11 to be sealed in the cells 12. The dimensions in the forward and backward direction 6 and the right and left direction 7 of the cell 21 can be determined as appropriate based on the amount or the like of information which is to be written down in the cell 21.

The PTP sheet 10 is one in which a first sheet 14 which is a thermoplastic resin and a second sheet 15 which is a laminated sheet thinner than the first sheet 14 are pasted to each other. The solid pharmaceuticals 11 are housed in the pockets 16 formed in the first sheet 14. The openings of the pockets 16 are closed with the second sheet 15.

When the pocket 16 of the first sheet 14 is pressed by the fingertip of a patient, the solid pharmaceutical 11 press and breaks the second sheet 15. Thus, the solid pharmaceutical 11 is taken out from the pocket 16 through the opening.

Hereinafter, each constituent member of the PTP sheet 10 is described in detail. In the following description, the upper surface and the lower surface of each sheet are based on the vertical direction 5 described above. An upper surface 31 of the first sheet 14 is equivalent to a first surface of the present invention and a lower surface 35 of the first sheet 14 (FIG. 7) is equivalent to a second surface of the present invention, respectively. A lower surface 32 of the second sheet 15 is equivalent to a third surface of the present invention. The vertical relationship of the upper surface and the lower surface in the following description is determined for convenience of description and the vertical relationship of the upper surface and the lower surface may be reversed.

[First Sheet 14]

The first sheet 14 illustrated in FIG. 1 to FIG. 3 is a sheet obtained by vacuum molding the thermoplastic resin. The thermoplastic resin is polypropylene (PP), polyvinyl chloride (PVC), polyethylene terephthalate (PET), cyclic polyolefin, or the like, for example. The first sheet 14 may be configured by laminating two or more kinds of resin layers. Even when another kind of resin is used for the first sheet 14, it is preferable for the first sheet 14 to contain a thermoplastic resin as the main component.

The first sheet 14 has fixed translucency but may not have translucency.

The thickness of the first sheet 14 is larger than the second sheet 15 described later and is preferably in the range of 200 μm to 350 μm.

The slits 13 are formed on the boundary between the cells 12. The slit 13 is an approximate V-shaped groove formed in the upper surface 31 of the first sheet 14. The depth of the slit 13 is slightly longer than half of the thickness of the first sheet 14. The slit 13 may be perforations in which minute holes are periodically formed. Or, the slit 13 may be one in which grooves and perforations are superimposed. In a manufacturing stage of the PTP sheet 10, rollers having a blade on the peripheral edge relatively move in a state of pressing the upper surface of the first sheet 14. Thus, the slits 13 are formed in the first sheet 14.

Two pockets 16 are provided in each cell 12 of the first sheet 14. The pocket 16 is molded in a dome shape in such a manner that the first sheet 14 projects upward. More specifically, the pocket 16 is projected to the side of the upper surface 31 which is one of the back surface and the front surface of the first sheet 14. More specifically, in the pocket 16, the upper surface 31 of the first sheet 14 is projected upward and the lower surface 35 is recessed upward. In the recessed portion, an internal space in which the solid pharmaceutical 11 is housed is formed. An opening connecting the internal space and the exterior space is opened to the lower surface 35 side of the first sheet 14. The pocket 16 has a size which allows complete housing of the solid pharmaceutical 11. The size can be determined as appropriate based on the size of the solid pharmaceutical 11. The shape of the pocket 16 can be determined as appropriate based on the shape of the solid pharmaceutical 11.

[Second Sheet 15]

The second sheet 15 is a laminated sheet in which resin is laminated on the back surface and the front surface of a metallic foil 34 as illustrated in FIG. 5. On one of the back surface and the front surface of the metallic foil 34, an acrylic resin 33 is laminated and, on the other side, a vinyl chloride resin (not illustrated) is laminated. Herein, the one surface of the back surface and the front surface is a surface on the side where the information on the solid pharmaceutical 11 is printed and the other surface of the back surface and the front surface is a surface on the side to which the first sheet 14 is pasted. Herein, the metallic foil 34 is aluminum foil but may be metal other than aluminum. The resin laminated on the one surface of the back surface and the front surface of the metallic foil 34 may be resin other than the acrylic resin insofar as ink or the like can adhere in printing the information on the solid pharmaceutical 11 described later. The resin laminated on the other surface of the back surface and the front surface of the metallic foil 34 may be resin other than the vinyl chloride resin insofar as the resin semi-dissolves in thermocompression bonding described later.

The second sheet 15 is not limited to the laminated sheet in which resin is laminated on the metallic foil 34 and may be a laminated sheet in which a plurality of resin films are laminated and pasted to each other and which does not contain metal, for example, insofar as the airtightness of the pockets 16 can be secured.

As illustrated in FIG. 1 to FIG. 3, the second sheet 15 is pasted to the lower surface 35 of the first sheet 14 in the state where the solid pharmaceuticals 11 are housed in the pockets 16. The openings of the pockets 16 are covered with the second sheet 15 and the solid pharmaceuticals 11 are sealed in the pockets 16.

In taking out the solid pharmaceutical 11, a patient presses the pocket 16 by the fingertip. Thus, the pocket 16 is deformed, and then the solid pharmaceutical 11 is pressed to the second sheet 15 side by the fingertip of the patient over the pocket 16. The solid pharmaceutical 11 presses and breaks the second sheet 15 to be taken out to the outside from the opening of the pocket 16.

The thickness of the second sheet 15 is a thickness which allows the breakage of the second sheet 15 by the fixed pressing force from the solid pharmaceutical 11. The thickness of the second sheet 15 is determined as appropriate based on the hardness of the solid pharmaceutical 11, e.g., whether the solid pharmaceutical 11 is a tablet or a capsule agent, for example. The thickness of the second sheet 15 is preferably in the range of 20 μm to 25 μm.

The second sheet 15 is pasted to the first sheet 14, in which the solid pharmaceuticals 11 are housed in the pockets 16, by thermocompression bonding. A detail description is given below. In the manufacturing process of the PTP sheet 10, the first sheet 14 and the second sheet 15 pass through a space between a roller pair, in which one roller placed in an apparatus for manufacturing the PTP sheet 10 is heated, while being brought into pressure contact with each other by the roller pair in the state where the first sheet 14 and the second sheet 15 are overlapped with each other. Thus, the first sheet 14 and the second sheet 15 are thermocompression bonded to each other. In detail, the vinyl chloride resin of the second sheet 15 semi-dissolves with the heat. Thus, the first sheet 14 and the second sheet 15 are pasted to each other.

A means of pasting the first sheet 14 and the second sheet 15 to each other is not limited to the means described above. For example, both the sheets 14 and 15 may be pasted to each other by applying an adhesive, which can be pasted to both the sheets 14 and 15, to at least one of the lower surface 35 of the first sheet 14 and the upper surface of the second sheet 15.

[First Region 41 and Second Region 42]

As illustrated in FIG. 1B, FIG. 2B, and FIG. 3F, the lower surface 32 of the second sheet 15 has a first region 41, a second region 42, and a third region 43. The first region 41 has mesh-shaped grooves 44. The depth of the groove 44 is a first depth. The first depth may be any depth insofar as the depth is smaller than the thickness of the second sheet 15 and is preferably smaller than half of the thickness of the second sheet 15. The cross-sectional shape of the groove 44 is a V-shape. The cross-sectional shape of the groove of the groove 44 is not limited to the V-shape and may be a rectangular shape, for example.

The second region 42 also has mesh-shaped grooves similarly to the first region 41. The depth of the groove of the second region 42 is a second depth smaller than the first depth. In FIG. 1 to FIG. 4, in order to show that the second depth is smaller than the first depth, the illustration of the groove of the second region 42 is omitted. The second depth may be any depth insofar as the depth is less than the first depth and is preferably 100 μm or less. The second depth is most preferably zero. More specifically, it is the most preferable that the second region 42 has no grooves.

The third region 43 is a region corresponding to a region on the opposite side to the pocket 16 provided in the first sheet 14. The third region 43 has no mesh-shaped grooves.

The grooves of the first region 41 and the second region 42 described above are formed as follows, for example. More specifically, the mesh-shaped convex portions are formed in the roller abutting on the lower surface 32 of the second sheet 15 in the roller pair placed in the manufacturing apparatus of the PTP sheet 10. Herein, the convex portion is configured so that the projection length of a portion abutting on the second region 42 of the lower surface 32 is shorter than a portion abutting on the first region 41 of the lower surface 32.

When the roller pair described above holds the first sheet 14 and the second sheet 15 while bringing the first sheet 14 and the second sheet 15 into pressure contact, the lower surface 32 of the second sheet 15 is pressed by the convex portions of the roller. Thus, the upper surface side of the second sheet 15 is projected in a mesh shape which is the shape of the convex portions. More specifically, the mesh-shaped grooves are formed in the first region 41 and the second region 42 of the lower surface 32 of the second sheet 15. Then, due to the difference in the projection length described above, the depth in the first region 41 is longer than the depth of the second region 42 in the formed grooves.

When the mesh-shaped grooves are formed by the method described above, no mesh-shaped grooves are formed in the third region 43 or grooves shallower than the grooves of the first region 41 and the second region 42 are formed therein. This is because the back side of the third region 43 is the space formed by the pocket 16, and therefore, even when the third region 43 is pressed by the convex portion of the roller, the third region 43 bends as a whole.

By not providing convex portions in a portion abutting on the second region 42 of the roller, the depth of the groove in the second region 42 can be set to zero.

A method for forming the mesh-shaped grooves is not limited to the method described above. For example, while the projection length of the mesh-shaped convex portions formed in the roller abutting on the lower surface 32 of the second sheet 15 in the roller pair is fixed, an elastic member softer than the roller may be attached to a portion corresponding to the second region 42 of the roller abutting on the upper surface 31 of the first sheet 14 in the roller pair. Herein, the portion corresponding to the second region 42 is a portion where the second region 42 of the lower surface 32 of the second sheet 15 is held between the facing rollers of the surface of the roller. By configuring the PTP sheet as described above, the mesh-shaped grooves can be formed in such a manner that the depth in the first region 41 is smaller than the depth of the second region 42. Or, no grooves are formed in the first region 41.

On the lower surface 32 of the second sheet 15, information on the solid pharmaceutical 11 can be printed. Herein, the information on the solid pharmaceutical 11 includes the serial number, the expiration date for use, the year and month of manufacture, and the like of the solid pharmaceutical 11, for example. Moreover, the information on the solid pharmaceutical 11 is indicated also with a code which can be optically read, such as a bar code or a two dimensional code (for example, QR Code (Registered Trademark)). The code includes information specifying the solid pharmaceutical 11, such as the serial number described above, and also includes a dosing method of the solid pharmaceutical 11 and the like.

The information on the solid pharmaceutical 11 described above can be printed in any region of the first region 41, the second region 42, and the third region 43. However, the code described above is preferably printed in the second region 42 rather than the first region 41 and the third region 43 and is printed in the second region 42 in this embodiment. This is because, when it is supposed that the code described above is printed in the first region 41, a possibility that the code is deleted or distorted due to the unevenness of the mesh-shaped grooves becomes higher than a possibility in the case where the code is printed in the second region 42. Moreover, this is because, in the case where the code described above is printed in the third region 43, when the third region 43 is pressed and broken in taking out the solid pharmaceutical 11, the information printed in the third region 43 cannot be read after the breakage.

The characters, the figures, the code described above, and the like printed in the lower surface 32 of the second sheet 15 are printed by spraying ink droplets by an ink jet system. Since it is preferable that the sprayed ink is quickly dried, it is preferable that a heat curable ink and an ultraviolet curable ink are used for the ink. The printing system is not limited to the ink jet system and may be a system including applying ink or may be a system in which a pharmacist or a patient writes down the information with a pen.

The characters, the figures, the code described above, and the like are printed on the lower surface 32 of the second sheet 15 after the first sheet 14 and the second sheet 15 are pasted to each other by thermocompression bonding. The characters, the figures, the code described above, and the like may be printed beforehand on the lower surface 32 of the second sheet 15 before the first sheet 14 and the second sheet 15 are pasted to each other by thermocompression bonding, and then the first sheet 14 and the second sheet 15 may be pasted to each other by thermocompression bonding. However, it is more preferable that the characters, the figures, the code described above, and the like are printed after the first sheet 14 and the second sheet 15 are pasted to each other.

The second region 42 has a rectangular shape. The second region 42 is a region in the central portion of the lower surface 32 of the second sheet 15 in the forward and backward direction 6 and in the right and left direction 7. The length in the right and left direction 7 (longitudinal direction of the lower surface 32 of the second sheet 15) of the second region 42 is preferably shorter than the length in the forward and backward direction 6 (short direction of the lower surface 32 of the second sheet 15) of the second region 42.

The third region 43 is a region corresponding to a region on the inner side relative to the edge forming the dome of the pocket 16 and has an oval shape. The number of the third regions 43 to be formed is the same number (ten places in the case of FIG. 1 to FIG. 3) of the pockets 16. The first region 41 occupies a region other than the second region 42 and the third regions 43 on the lower surface 32 of the second sheet 15.

The first region 41 occupies the entire edge of the lower surface 32. Therefore, the second region 42 and the third regions 43 do not contact the edge of the lower surface 32 of the second sheet 15. More specifically, the first region 41 is present between the second region 42 and the edge of the lower surface 32 and between the third regions 43 and the edge of the lower surface 32.

The second region 42 and the third regions 43 are partially overlapped with each other. For example, in the case of FIG. 1 to FIG. 3, the outside in the forward and backward direction 6 of the second region 42 and the center side in the forward and backward direction 6 of all the third regions 43 provided at ten places are overlapped with each other. The overlapped area of the second region 42 and one third region 43 is preferably equal to or less than half of the area of the third region 43.

The overlapped area of the second region 42 and the third region 43 may be larger than half of the area of one third region 43. For example, the entire region of the third region 43 may be overlapped with the second region 42. In other words, the second region 42 may contain the entire region of the third region 43.

The position of the second region 42 is not limited to the position illustrated in FIG. 4B insofar as the position is a position not contacting the ends of the lower surface 32 of the second sheet 15. For example, the second region 42 may be provided in the cell 21 as illustrated in FIG. 6A. Moreover, the second region 42 may be provided between the third region 43 and the end of the lower surface 32 in the forward and backward direction 6 as illustrated in FIGS. 6B and 6C.

The second region 42 is not limited to the rectangular shape. For example, the second region 42 may have a circular shape and a triangular shape or may be a special shape, such as a T shape as illustrated in FIG. 6E.

Moreover, the second region 42 is not limited to one. For example, two or more of the second regions 42 may be provided as illustrated in FIGS. 6D and 6F.

In the second region 42, the length in the short direction may be longer than the length in the longitudinal direction as illustrated in FIGS. 6A and 6F. The second region 42 may be configured from a region where the length in the longitudinal direction is longer than the length in the short direction and a region where the length in the short direction is longer than the length in the longitudinal direction as illustrated in FIG. 6D.

The shape and the size of the third region 43 are determined based on the shape and the size of the solid pharmaceutical 11 to be housed in the pocket 16 and the shape is not limited to the oval shape and may have a circular shape, a square shape, or a triangular shape, for example, depending on the shape of the solid pharmaceutical 11.

As illustrated in FIG. 5, a material to be recorded 22 on which ink droplets 23 can land, e.g., a coating at least containing titanium oxide, adheres to the second region 42 on the upper surface 31 of the second sheet 15. In detail, the material to be recorded 22 adheres to one of the back surface and the front surface of the metallic foil 34 of the second sheet 15. The acrylic resin is applied in such a manner as to cover the material to be recorded 22 and the metallic foil 34. The material to be recorded 22 adhering to the second region 42 is preferably a coating containing titanium oxide but is not limited to the coating containing titanium oxide. The material to be recorded 22 may not adhere to the second region 42.

The material to be recorded 22 adhering to the second region 42 is white but may not be white insofar as the color can increase the contrast between the ink droplets 23 landing on the second region 42 and the material to be recorded 22. For example, when the ink droplets 23 have a dark color, such as black, it is preferable for the material to be recorded 22 has a bright color, such as yellow. On the contrary, when the ink droplets 23 have a bright color, such as white, it is preferable for the material to be recorded 22 has a dark color, such as black. As described above, when the material to be recorded 22 does not adhere to the second region 42, the second region 42 exhibits silver color which is the color of aluminum.

[Manufacturing Apparatus 50]

A manufacturing apparatus 50 illustrated in FIG. 8 is an apparatus for manufacturing the PTP sheet 10. The manufacturing apparatus 50 manufactures the PTP sheet 10 by controlling each constituent component described later by a control unit, which is not illustrated, having a microcomputer and the like. In the description of the configuration of the manufacturing apparatus 50, a vertical direction 1055 is defined on the basis of the state where the manufacturing apparatus 50 is disposed in such a manner as to be used, the axial direction of each roller placed in the manufacturing apparatus 50 is defined as a forward and backward direction 106, and a direction orthogonal to the vertical direction 105 and the forward and backward direction 106 is defined as a right and left direction 107.

The manufacturing apparatus 50 has, as the constituent components, a first roll 51 around which the beltlike first sheet 14 is wound, a first conveyance unit 52 conveying the first sheet 14 wound around the first roll 51, a pocket formation unit 53 forming the pocket 16 projected to the upper surface 31 side of the first sheet 14 to be conveyed by the first conveyance unit 52 and capable of housing the solid pharmaceutical 11, a pharmaceutical loading unit 54 loading the solid pharmaceutical 11 in the pocket 16 formed by the pocket formation unit 53, a second roll 55 around which the second beltlike sheet 15 is wound, a second conveyance unit 56 conveying the second sheet 15 wound around the second roll 55, a pasting unit 70 pasting the first sheet 14 and the second sheet 15 to each other, a printing unit 90 printing an image on the second sheet 15 after being pasted to the first sheet 14 by the pasting unit 70 and on the second sheet 15 to be conveyed by the second conveyance unit 56, and a stamping unit 57 stamping a beltlike sheet in which the first beltlike sheet 14 and the second beltlike sheet 15 are pasted to each other to form two or more of the PTP sheets 10.

The manufacturing apparatus 50 has a case 17. In the case 17, the first roll 51, the first conveyance unit 52, the pocket formation unit 53, the pharmaceutical loading unit 54, the second roll 55, the second conveyance unit 56, the pasting unit 70, the printing unit 90, and the stamping unit 57 described above are placed.

The first roll 51 is configured from a shaft 61 extending in the forward and backward direction and the first beltlike sheet 14 wound around the shaft 61. The first sheet 14 is not wound around both ends of the shaft 61. Both the ends of the shaft 61 are rotatably supported by a shaft support portion provided on the internal surface of the case 17. The first sheet 14 wound around the shaft 61, the portion is partially drawn out. The drawn-out first sheet 14 is set along a conveyance path in such a manner as to reach the pasting unit 70 through the first conveyance unit 52, the pocket formation unit 53, and the pharmaceutical loading unit 54.

The first sheet 14 preferably has a thickness in the range of 200 μm to 350 μm. Due to the fact that the thickness of the first sheet 14 is in the range mentioned above, the airtightness of the pocket 16 can be secured without excessively thickening the first sheet 14. In this embodiment, the first sheet 14 has a thickness of 250 μm.

The first conveyance unit 52 is provided on the downstream side in the conveyance direction (indicated by the arrows in FIG. 8) of the first sheet 14 relative to the first roll 51. The first conveyance unit 52 is configured from a roller rotating around the shaft extending in the forward and backward direction. The first conveyance unit 52 is disposed at a position abutting on the lower surface 35 of the first sheet 14 but may be disposed at a position abutting on the upper surface 31. The first sheet 14 abuts on the first conveyance unit 52 in the state where the direction is turned from the upward direction to the right direction and the first sheet 14 is stretched. Thus, the state where the lower surface 35 of the first sheet 14 abuts on the first conveyance unit 52 can be held. Due to the fact that the first conveyance unit 52 to which drive is transmitted from the motor rotates, the first sheet 14 wound around the first roll 51 is drawn out from the first roll 51 to be conveyed in the conveyance direction. As described above, the first conveyance process of the present invention is carried out by the first conveyance unit 52.

In FIG. 1, although the first conveyance unit 52 is provided at a position on the downstream side relative to the first roll 51 and on the upstream side relative to the pocket formation unit 53 in the conveyance direction of the first sheet 14, the first conveyance unit 52 may be provided at positions other than the above-described position insofar as the position is located on the conveyance path of the first sheet 14. In FIG. 8, one first conveyance unit 52 is provided but two or more of the first conveyance units 52 may be provided.

The pocket formation unit 53 is provided on the downstream side relative to the first roll 51 in the conveyance direction of the first sheet 14. The pocket formation unit 53 has a heater heating the first sheet 14 and a spraying unit spraying air to the lower surface 35 of the first sheet 14 heated with the heater. The spraying unit sprays air at a fixed interval from a plurality of outlets provided at a fixed interval along the forward and backward direction. Thus, the portion is recessed to which air is sprayed of the lower surface 35 of the first sheet 14 which is heated to be softened by the heater. More specifically, the back side of the portion to which air is sprayed on the lower surface 35 of the upper surface 31 of the first sheet 14 is projected. As a result, two or more of the dome-shaped pockets 16 are formed in the shape of a lattice at a fixed interval from each other in the upper surface 31 side of the first sheet 14. By configuring the position of the spraying unit and the interval value to be different from the position and the value described above, the position and the interval of the pockets 16 can be variously set. As described above, the pocket formation process of the present invention is carried out by the pocket formation unit 53.

The pharmaceutical loading unit 54 has a housing portion 62 in which a plurality of solid pharmaceuticals 11 are housed in the internal space and a hollow discharging unit 63 discharging the solid pharmaceuticals 11 housed in the housing portion 62 one by one. Two or more of the discharging units 63 are projected from the lower side of the housing portion 62. The two or more of the discharging units 63 are provided at a fixed interval along the forward and backward direction. The tip portion of each discharging unit 63 is provided at a position where the tip portion can face a position corresponding to the pocket 16 on the lower surface 35 of the first sheet 14 to be conveyed with the tip portion as the upper side and the first sheet 14 as the lower side. The internal space of the housing portion 62 and the internal space of the discharging unit 63 are continuous to each other. The size of the surface along the forward and backward direction 106 and the right and left direction 107 of the tip portion of each discharging unit 63 is approximately the same as the size of one solid pharmaceutical 11. The tip portion of each discharging unit 63 opens and closes. The timing at which each discharging unit 63 opens is the timing when the discharging unit 63 faces the pocket 16 formed in the first sheet 14 to be conveyed. The time when each discharging unit 63 opens is the time when only one solid pharmaceutical 11 is discharged. It is a matter of course that each discharging unit 63 may be provided with a stopper which prevents the discharge of the second solid pharmaceutical 11 and the like. As described above, by the opening of each discharging unit 63, one solid pharmaceutical 11 is discharged from each discharging unit 63 to be loaded in the pocket 16 of the first sheet 14. As described above, the pharmaceutical loading process of the present invention is carried out by the pharmaceutical loading unit 54.

The second roll 55 is configured from a shaft 64 extending in the forward and backward direction and a second beltlike sheet 15 wound around the shaft 64. The second sheet 15 is not wound around both ends of the shaft 64. Both the ends of the shaft 64 are rotatably supported by a shaft support portion provided on the internal surface of the case 17. The second sheet 15 wound around the shaft 61 is partially drawn out. The drawn-out second sheet 15 is set along the conveyance path in such a manner that the tip of the drawn-out portion reaches the pasting unit 70 through the second conveyance unit 56.

The second sheet 15 preferably has a thickness in the range of 20 μm to 25 μm. Due to the fact that the thickness of the second sheet 15 is in the range mentioned above, the airtightness of the pocket 16 whose opening is covered with the second sheet 15 is secured and also the ease of breaking the second sheet 15 in taking out the solid pharmaceutical 11 from the pocket 16 can be secured. In this embodiment, the second sheet 15 has a thickness of 20 μm.

As illustrated in FIG. 13, the second sheet 15, which is an aluminum laminated sheet, is a sheet in which the acrylic resin 33 is laminated on one of the back surface and the front surface of the metallic foil 34, which is aluminum foil, and the vinyl chloride resin 37 (an example of the adhesive agent of the present invention) is laminated on the other side. The surface on which the acrylic resin 33 is laminated is the lower surface 32 of the second sheet 15 and is a surface on which the information on the solid pharmaceutical 11 is printed by the printing unit 90. The surface on which the vinyl chloride resin 37 is laminated is the upper surface 36 (an example of the fourth surface of the present invention) of the second sheet 15 and is pasted to the lower surface 35 of the first sheet 14 when the first sheet 14 and the second sheet 15 are pasted to each other by the pasting unit 70 described later. In FIG. 13, the vertical direction 105 of the second sheet 15 in the manufacturing apparatus 50 is illustrated and the upper and lower sides are reversed to those in the vertical direction 5 in the PTP sheet 10.

As illustrated in FIG. 8, the second conveyance unit 56 is provided on the downstream side relative to the second roll 55 in the conveyance direction (indicated by the arrows in FIG. 8) of the second sheet 15. The second conveyance unit 56 is configured from a roller rotating around the shaft extending in the forward and backward direction 106. The second conveyance unit 56 is disposed at a position abutting on the lower surface 32 of the second sheet 15 but may be disposed at a position abutting on the upper surface 36. The second sheet 15 abuts on the second conveyance unit 56 in the state where the direction is changed and the second sheet 15 is stretched. Thus, the state where the lower surface 32 of the second sheet 15 abuts on the second conveyance unit 56 can be held. Due to the fact that the second conveyance unit 56 to which drive is transmitted from the motor rotates, the second sheet 15 wound around the second roll 55 is drawn out from the second roll 55 to be conveyed in the conveyance direction. As described above, the second conveyance process of the present invention is carried out by the second conveyance unit 56.

In FIG. 8, although the second conveyance unit 56 is provided on the downstream side relative to the second roll 55 and on the upstream side relative to the pasting unit 70 in the conveyance direction of the second sheet 15, the second conveyance unit 56 may be provided at positions other than the above-described position insofar as the position is located on the conveyance path of the second sheet 15. In FIG. 8, two second conveyance units 56 are provided but one or three or more of the first conveyance units 52 may be provided.

The stamping unit 57 is provided on the downstream side relative to the printing unit 90 in the conveyance direction (indicated by the arrows in FIG. 8) of the beltlike sheet in which the first sheet 14 and the second sheet 15 are pasted to each other. The stamping unit 57 stamps the beltlike sheet into the PTP sheet 10 of the size illustrated in FIG. 1. Thus, one beltlike sheet gives two or more of the PTP sheets 10. The plurality of PTP sheets 10 stamped from the beltlike sheet by the stamping unit 57 are dropped in a storage portion 58 disposed below the stamping unit 57 to be stored in the storage portion 58.

[Pasting Unit 70]

As illustrated in FIG. 8, the pasting unit 70 is provided on the downstream side relative to the pharmaceutical loading unit 54 in the conveyance direction of the first sheet 14 and on the downstream side relative to the second conveyance unit 56 in the conveyance direction of the second sheet 15 and is provided on the upstream side relative to the printing unit 90 in the conveyance direction of the first sheet 14 and the second sheet 15. The pasting process of the present invention is carried out by the pasting unit 70. The pasting unit 70 has the first roller 71 and the second roller 72. The first roller 71 is provided under the conveyance path of the first sheet 14 and the second sheet 15. The second roller 72 is provided facing the first roller 71 on the conveyance path of the first sheet 14 and the second sheet 15. The first roller 71 and the second roller 72 are disposed having an interval which allows holding of the first sheet 14 and the second sheet 15 in a pressure contact state while the first sheet 14 and the second sheet 15 are laminated.

The first sheet 14 to be conveyed enters a space between the first roller 71 and the second roller 72 with the upper surface 31 facing downward. The second sheet 15 to be conveyed enters a space between the first roller 71 and the second roller 72 with the lower surface 32 facing upward above the first sheet 14. As described above, the first roller 71 abuts on the upper surface 31 of the first sheet 14 and the second roller 72 abuts on the lower surface 32 of the second sheet 15.

As illustrated in FIG. 9, the first roller 71 has a shaft 73 extending in the forward and backward direction and a roller portion 75 covering the circumference of the shaft 73. The first roller 71 rotates around the shaft 73 by drive transmitted from a motor.

As illustrated in FIG. 9 and FIG. 10, a plurality of first concave portions 76 and a plurality of second concave portions 77 are formed in the surface of the roller portion 75 of the first roller 71.

The plurality of second concave portions 77 are formed at a fixed interval from each other. As illustrated in FIG. 11, ten second concave portions 77 in total at five places in the direction along the shaft 73 and at two places in the direction along the circumferential direction of the roller portion 75 are formed as one group. Two groups of the second concave portions 77 are formed in a direction in which the groups are formed along the shaft 73 as illustrated in FIG. 10A and the second concave portions 77 are formed in the entire region in the circumferential direction of the roller portion 75 as illustrated in FIG. 9 and FIG. 10C. The positions of the second concave portions 77 are positions corresponding to the pockets 16 of the first sheet 14 to be conveyed. The second concave portion 77 has the same circular shape as that of the pocket 16 and the diameter of the second concave portion 77 is slightly larger than the diameter of the circle. The depth of the second concave portion 77 is a slightly larger than the projection length of the pocket 16. Thus, the pockets 16 of the first sheet 14 are housed in the second concave portions 77.

The plurality of first concave portions 76 are formed at a fixed interval from each other. The first concave portions 77 are formed at two places in the direction along the shaft 73 as illustrated in FIG. 10A and the first concave portions 77 are formed in the entire region in the circumferential direction of the roller portion 75 as illustrated in FIG. 9.

The positions in the direction along the shaft 73 of the first concave portions 76 are positions on the inner side relative to both ends in the direction along the shaft 73 of the second sheet 15 in the state of abutting on the second roller 72.

As illustrated in FIG. 11, the first concave portion 76 has a rectangular shape as viewed in plan. The first concave portion 76 is overlapped with all the second concave portions 77 configuring the one group, i.e., internal portions of the second concave portions 77 at ten places, on the surface of the roller portion 75. The first concave portion 76 may be overlapped with only some of the second concave portions 77 at ten places or may not be overlapped with all the second concave portions 77 at ten places. On the surface of the first roller 71, the overlapped area of the first concave portion 76 and one second concave portion 77 is equal to or less than half of the area of the second concave portion 77. In FIG. 11, in the second concave portions 77 at the four corners among the second concave portions 77 at ten places, regions smaller than one fourth of the inner side are overlapped with the first concave portion 76. In the second concave portions 77 other than the second concave portions 77 at the four corners among the second concave portions 77 at ten places, regions smaller than one half of the inner sides are overlapped with the first concave portions 76.

As illustrated in FIG. 12A, the depth of the first concave portion 76 is smaller than the depth of the second concave portion 77. The depth of the first concave portion 76 is preferably in the range of 0.1 mm to 2.0 mm and more preferably in the range of 0.5 mm to 1.5 mm. In this embodiment, the depth of the first concave portion 76 is 1.0 mm.

As illustrated in FIG. 12B, the elastic member 78 is embedded in the first concave portion 76. As illustrated in FIG. 11, the elastic member 78 has a rectangular parallelepiped shape. In detail, the elastic member 78 has a plate shape in which the length in the thickness direction is shorter than the lengths in the other two directions in the three-dimensional coordinates. The lengths of the two sides of the back surface and the front surface of the plate-shaped elastic member 78 are approximately equal to the lengths of the two sides as viewed in plane of the first concave portion 76. The thickness of the elastic member 78 is slightly larger than the depth of the first concave portion 76. The thickness of the elastic member 78 is not limited to the thickness illustrated in FIG. 12B insofar as the thickness is equal to or larger than the depth of the first concave portion 76.

The elastic member 78 contains silicon rubber. Herein, the first roller 71 contains metal, such as an aluminum alloy. More specifically, the elastic member 78 is softer than the first roller 71. The elastic member 78 is not limited to metal, such as an aluminum alloy, insofar as the elastic member 78 is harder than the first roller 71.

The position of the first concave portion 76 is a position corresponding to the second region 42 (FIG. 1) of the second sheet 15. More specifically, the first concave portion 76 is provided at a position where the elastic member 78 embedded in the first concave portion 76 holds the material to be recorded 22 (FIG. 13) which is a coating containing titanium oxide adhering to the second region 42 with the second roller 72.

As illustrated in FIG. 2, the second roller 72 has a shaft 74 extending in the forward and backward direction and a roller portion 79 covering the circumference of the shaft 74. The second roller 72 rotates around the shaft 74 by drive transmitted from a motor.

In the surface of the roller portion 79 of the second roller 72, mesh-shaped convex portions 80 are formed. In detail, quadrangular pyramid-shaped recesses are formed in the shape of a lattice in the surface of the roller portion 79. Thus, portions which are not recessed in the surface of the roller portion 79 serve as the mesh-shaped convex portions 80. The mesh-shaped convex portions 80 are not limited to those formed by the quadrangular pyramid-shaped recesses as described above. For example, the convex portions 80 may be mesh-shaped ribs formed in the surface of the roller portion 79. The projection amounts of the convex portions 80 are fixed.

A heater is placed in the second roller 72. Thus, the surface of the roller portion 79 of the second roller 72 is heated.

[Printing Unit 90]

As illustrated in FIG. 8, the printing unit 90 is provided on the downstream side relative to the pasting unit 70 in the conveyance direction of the first sheet 14 and the second sheet 15 and on the upstream side relative to the stamping unit 57 in the conveyance direction of the first sheet 14 and the second sheet 15. The printing process of the present invention is carried out by the printing unit 90.

The printing unit 90 prints an image on the lower surface 32 of the second sheet 15. Herein, the printing unit 90 prints an image in the second region 42 (FIG. 1) of the lower surface 32. More specifically, the printing unit 90 prints an image in a region held between the elastic member 78 and the second roller 72 of the lower surface 32 in pasting by the pasting unit 70.

The printing unit 90 prints an image on the lower surface 32 of the second sheet 15 by a known ink jet system. A detail description is given below. The printing unit 90 has an ink tank (not illustrated) in which ultraviolet curable ink is stored and a plurality of nozzles 91 provided at positions facing the lower surface 32 of the second sheet 15 to be conveyed. The ink tank and the nozzles 91 communicate with each other. FIG. 8 illustrates five nozzles 91 for convenience but the number of the nozzles 91 is not limited to five pieces. The printing unit 90 discharges ink droplets to the second region 42 of the lower surface 32 of the second sheet 15 from the plurality of nozzles 91 based on image data output from a control unit. Thus, characters, figures, a code which can be optically read, and the like are printed in the second region 42. The ink is not limited to the ultraviolet curable ink and may be a heat curable ink, for example.

[Manufacturing of PTP Sheet 10 by Manufacturing Apparatus 50]

Hereinafter, the manufacturing operation of the PTP sheet 10 by the manufacturing apparatus 50 is described. In particular, the operation of the pasting unit 70 is described in detail.

The first roll 51 around which the first sheet 14 is wound is set in such a manner that the tip of the drawn-out portion is located in the pasting unit 70 through the first conveyance unit 52, the pocket formation unit 53, and the pharmaceutical loading unit 54. The second roll 55 around which the second sheet 15 is wound is set in such a manner that the tip of the drawn-out portion is located in the pasting unit 70 through the second conveyance units 56.

The first conveyance unit 52, the second conveyance units 56, the first roller 71, and the second roller 72 rotate by drive transmitted from a motor. Thus, the first sheet 14 and the second sheet 15 are conveyed in the conveyance direction. The motor may be individually formed for each conveyance unit and each roller or may be shared by at least one conveyance unit and at least one roller.

The pockets 16 are formed in the first sheet 14 to be conveyed by the pocket formation unit 53 and the solid pharmaceuticals 11 are loaded in the pockets 16 by the pharmaceutical loading unit 54.

The first sheet 14 and the second sheet 15 loaded with the solid pharmaceutical 11 are conveyed by the first conveyance unit 52 and the second conveyance unit 56, so that the first sheet 14 and the second sheet 15 enter a space between the first roller 71 and the second roller 72 of the pasting unit 70 in a state where the lower surface 35 of the first sheet 14 and the upper surface 36 of the second sheet 15 face each other. Thus, the first sheet 14 and the second sheet 15 are held between the first roller 71 and the second roller 72, so that the lower surface 35 and the upper surface 36 abut on each other.

In this operation, the pockets 16 of the first sheet 14 are housed in the second concave portions 77 of the first roller 71. Due to the fact that the second roller 72 contacts the second sheet 15 under pressure, the mesh-shaped convex portions 80 are pressed against the lower surface 32 of the second sheet 15. Thus, the mesh-shaped grooves 44 (FIG. 1B) are formed in the lower surface 32 of the second sheet 15.

Herein, the depth of the grooves 44 formed in the region held between the elastic member 78 embedded in the first roller 71 and the second roller 72 of the lower surface 32 of the second sheet 15 is smaller than the grooves formed in a region held between a portion other than the elastic member 78 in the first roller 71 and the second roller 72 of the lower surface 32 of the second sheet 15 or the grooves 44 are not formed therein. This is because the pressing force by the first roller 71 is reduced by the elastic member 78. As described above, the lower surface 32 of the second sheet 15 has the first region 41 where the deep grooves 44 are formed and the second region 42 where the shallow grooves are formed or no grooves are formed.

In this operation, the vinyl chloride resin 37 laminated on the upper surface 36 of the second sheet 15 is heated by the surface of the roller portion 79 of the second roller 72 which abuts on the second sheet 15 and is heated by the heater to semi-dissolve. Thus, the lower surface 35 of the first sheet 14 and the upper surface 36 of the second sheet 15 are pasted to each other.

The first sheet 14 and the second sheet 15 which are pasted to each other by the pasting unit 70 are conveyed to the printing unit 90. The printing unit 90 prints information on the solid pharmaceutical 11, including characters, figures, a bar code, and the like, in the second region 42 of the lower surface 32 of the second sheet 15.

The first sheet 14 and the second sheet 15 on which the information is printed are conveyed to the stamping unit 57. The stamping unit 57 stamps the first sheet 14 and the second sheet 15 which have a beltlike shape and are pasted to each other into the PTP sheet 10 of the size illustrated in FIG. 1. Specifically, by stamping the circumference of the above-described one group in the lower surface 32 into a rectangular shape, one PTP sheet is generated. The plurality of stamped PTP sheets 10 are stored in the storage portion 58.

[Operational Effects of Embodiment]

According to this embodiment, the grooves of the second region 42 are shallower than the grooves of the first region 41 or no grooves are formed in the second region 42. Therefore, when characters, figures, a code which can be optically read, and the like are printed in the second region 42, the deletion or the distortion of the printed code and the like can be reduced. As a result, the information on the solid pharmaceutical printed as the code which can be optically read can be correctly and quickly read.

Unless the grooves of the second region 42 are made shallow or no grooves are formed by reducing the pressure to the second region 42 to be smaller than the pressure to the first region 41 when the PTP sheet 10 is generated by bringing the first sheet 14 and the second sheet 15 into pressure-contact with each other, a possibility that a gap is formed between the second sheet 15 and the first sheet 14 in the second region 42 becomes high due to the fact that the pressure is insufficient. In this case, when it is supposed that the edge of the lower surface 32 is the second region 42, there is a possibility that liquid or the like enters the space in the pockets 16 through the gap generated in the edge of the lower surface 32. Thus, in this embodiment, the entire edge of the lower surface 32 is the first region 41 where the gap is hard to be formed due to the fact that the pressure is high. This can reduce the possibility that liquid or the like enters the space in the pockets 16 from the edge of the lower surface 32.

By overlapping the second region 42 and the third region 43 as in this embodiment, it is not necessary to completely separately provide the second region 42 and the third region 43. Thus, the area of the lower surface 32 of the second sheet 15 can be made small. As a result, the PTP sheet 10 can be made small.

When the second region 42 is a region where the material to be recorded 22 containing a predetermined substance is applied to the lower surface 32, the thickness in the second region 42 becomes larger than the thickness of the other region in the second sheet 15. In this case, when the overlapped area of the second region 42 and the third region 43 becomes large, the third region 43 of the second sheet 15 is hard to be broken, which makes it difficult to take out the pharmaceutical from the pocket 16. Thus, in this embodiment, the overlapped area of the second region 42 and the third region 43 is suppressed to be equal to or less than half of the area of the third region 43. Therefore, the difficulty of breaking the third region 43 of the second sheet 15 can be suppressed.

In the manufacturing process in which the pockets 16 are formed, the first sheet 14 formed with resin is contracted in the short direction but the second sheet 15 containing aluminum does not contract. Therefore, the PTP sheet 10 tends to be curved in the short direction with the lapse of time. When characters, figures, a code which can be optically read, and the like are printed in the second region 42 of the PTP sheet 10 which is curved in the short direction, the printed code and the like are deleted or distorted. Then, according to this embodiment, in the second region 42, the length along the longitudinal direction of the lower surface 32 which is hard to be curved is longer than the length along the short direction of the lower surface 32 which is likely to be curved. Thus, the deletion or the distortion of the code and the like described above can be suppressed.

When the second depth is zero, a level difference due to the grooves is not present at all in the second region 42. Therefore, the deletion or the distortion of the characters, the figures, the code which can be optically read, and the like printed in the second region 42 can be further reduced.

Moreover, according to this embodiment, a region where characters, figures, a code which can be optically read, and the like can be printed can be easily formed by the material to be recorded 22 on the lower surface 32 side of the second sheet 15.

Moreover, according to this embodiment, since the material to be recorded 22 is white, the contrast between the characters, the figures, the code which can be optically read, and the like to be printed in the second region 42 and the background of the second region 42 becomes high. Therefore, a possibility that the code and the like are erroneously read can be made low.

Moreover, according to this embodiment, when the pasting unit 70 pastes the first sheet 14 and the second sheet 15, the mesh-shaped grooves 44 are formed in the lower surface 32 of the second sheet 15 by being pressed by the convex portions 80 of the second roller 72. In this operation, since the elastic member 78 softer than the first roller 71 is embedded in the first concave portion 76, the pressing force of the second roller 72 to the region held between the elastic member 78 and the second roller 72 of the lower surface 32 of the second sheet 15 is reduced. Thus, the depth of the grooves 44 formed in the region is smaller than the depth of the grooves 44 formed in a region other than the region or the grooves 44 are not formed therein. As a result, the deletion or the distortion of the image printed by the printing unit 90 in the region where the shallow grooves 44 are formed can be reduced. More specifically, the information on the solid pharmaceutical 11 printed as the code which can be optically read can be correctly and quickly read.

When it is supposed that the first concave portions 76 are provided at positions corresponding to the ends of the second sheet 15 in the direction along the shaft 74 of the second roller 72, the pressing force by the second roller 72 to the ends of the first sheet 14 is reduced. As a result, there is a possibility that the manufactured PTP sheet 10 has a gap formed between the first sheet 14 and the second sheet 15 at the ends, so that liquid or the like enters the space in the pockets 16 from the ends. Thus, in this embodiment, the first concave portions 76 are provided at positions corresponding to the inner side relative to the ends of the second sheet 15 in the direction along the shaft 74 of the second roller 72. Therefore, the possibility that the gap is formed between the first sheet 14 and the second sheet 15 at the ends in the manufactured PTP sheet 10 becomes low, and thus the possibility that liquid or the like enters the space in the pockets 16 from the ends can be made low.

Moreover, according to this embodiment, the first concave portions 76 and the second concave portions 77 are provided in an overlapping manner on the surface of the first roller 71. Therefore, on the lower surface 32 of the PTP sheet 10 manufactured by the manufacturing apparatus 50, a region where an image is to be printed and a region corresponding to the space where the solid pharmaceutical 11 is loaded can be shared. Thus, the PTP sheet 10 can be made small.

When the material to be recorded 22 containing at least titanium oxide is applied to the region where the image is to be printed in the lower surface 32 of the second sheet 15 and the PTP sheet 10 is manufactured by the manufacturing apparatus 50 in such a manner that the first concave portions 76 and the second concave portions 77 are overlapped with each other as in this embodiment, the thickness of the region where the image is to be printed increases due to the application of the material to be recorded 22 in the PTP sheet 10. Therefore, it is difficult to break the second sheet 15 in taking out the solid pharmaceutical 11. Thus, in this embodiment, the overlapped area of the first concave portion 76 and the second concave portion 77 is suppressed to be equal to or less than half of the area of the second concave portion 77 on the surface of the first roller 71. Therefore, in the PTP sheet 10 manufactured by the manufacturing apparatus 50, the difficulty of breaking the second sheet 15 can be suppressed as described above.

Moreover, according to this embodiment, the printing unit 90 prints an image after the pasting by the pasting unit 70, and therefore the lower surface 32 after the image is printed is not pressed by the second roller 72. Therefore, a possibility that the image is deleted or distorted can be made low.

Moreover, according to this embodiment, since the ink is an ultraviolet curable, the ink landing on the lower surface 32 is quickly dried by being exposed to ultraviolet rays. Therefore, a possibility that bleeding of the ink due to accidental contact with the ink or the like can be made low.

[Modification]

In the above-described embodiment, the printing unit 90 prints an image on the lower surface 32 of the second sheet 15 after being pasted to the first sheet 14 by the pasting unit 70 but may print an image on the lower surface 32 of the second sheet 15 before being pasted to the first sheet 14 by the pasting unit 70. For example, the printing unit 90 may be provided on the downstream side relative to the second roll 55 in the conveyance direction of the second sheet 15 and on the upstream side relative to the pasting unit 70 in the conveyance direction of the second sheet 15.

EXAMPLES

Examples 1 to 12 of the PTP sheet according to the present invention were manufactured by setting the temperature and the pressure when bringing the first sheet and the second sheet into pressure contact with each other by the roller pair described above to various values. Specifically, Examples 1 to 4 are the PTP sheets manufactured at pressures of 0.1 MPa, 0.15 MPa, 0.2 MPa, and 0.25 MPa, respectively, at a temperature of 240° C. Examples 5 to 12 are the PTP sheets manufactured at temperatures of 225° C., 230° C., 235° C., 240° C., 245° C., 250° C., 255° C., and 260° C., respectively, at a pressure of 0.2 MPa.

The outer shape of Examples 1 to 12 is illustrated in FIG. 1. The dimensions of the back surface and the front surface of the PTP sheets according to Examples 1 to 12 are 88 mm and 31 mm. One PTP sheet is provided with ten pockets 16. The dimensions of the back surface and the front surface of each cell in which the pockets were provided in the PTP sheet are 31 mm and 15 mm. The dimensions of the back surface and the front surface of each cell in which no pockets were provided in the PTP sheet are 31 mm and 8 mm.

The first sheet is a sheet obtained by vacuum molding polypropylene and has a thickness of 300 μm. The second sheet is an aluminum laminated sheet in which an acrylic coating layer, aluminum foil, and a vinylchloride resin layer are laminated and has a thickness of 20 μm.

[Appearance Observation]

80 sheets of each of the PTP sheets according to Examples 1 to 12 were manufactured by the roller pair described above. In the appearance observation, 80 sheets of the PTP sheets of Example 1 to 12, i.e., 960 sheets in total, were visually observed to confirm (A) whether or not wrinkles are generated in the second sheet, (B) whether or not the mesh-shaped grooves are appropriately formed, and (C) whether or not the characters printed in the second sheet can be clearly read.

The results are shown in Table 1 and Table 2. "OK" in "Appearance" of Table 1 and Table 2 shows that good results were obtained in all the PTP sheets in the items (A) to (C), "Partially OK" shows that good results were not obtained in a small number of the PTP sheets, and "NG" shows that good results were not obtained in a large number of the PTP sheets.

"First depth" of Table 1 and Table 2 shows the depth of the grooves formed in the first region 41, "Second depth" shows the depth of the grooves formed in the second region 42, and "Difference" shows the difference between the "First depth" and the "Second depth". When the "Difference" is larger due to the fact that the "First depth" is large and the "Second depth" is small, the result of the item (B) is better. Table 1 and Table 2 show that the result of the item (B) is the best in Example 8.

As described above, it was confirmed that, when the temperature was 240° C. and the pressures were 0.2 MPa to 0.25 MPa and the pressures was 0.2 MPa and the temperatures were 240° C. to 260° C., the appearance of the second sheets of the manufactured PTP sheets was suitable.

TABLE 1

| | | Seal temperature 240° C. | | | | | |
|---|---|---|---|---|---|---|---|
| | Seal pressure | Appearance | Leak (Condition 1) | Leak (Condition 2) | First depth | Second depth | Difference |
| Ex. 1 | 0.10 MPa | NG | NG | NG | 33 μm | 27 μm | 6 μm |
| Ex. 2 | 0.15 MPa | NG | OK | NG | 36 μm | 28 μm | 8 μm |
| Ex. 3 | 0.20 MPa | OK | OK | OK | 55 μm | 19 μm | 36 μm |
| Ex. 4 | 0.25 MPa | OK | OK | OK | 64 μm | 40 μm | 24 μm |

TABLE 2

| | Seal temperature | Seal pressure 0.2 MPa | | | | | |
|---|---|---|---|---|---|---|---|
| | | Appearance | Leak (Condition 1) | Leak (Condition 2) | First depth | Second depth | Difference |
| Ex. 5 | 225° C. | NG | NG | NG | 38 μm | 28 μm | 10 μm |
| Ex. 6 | 230° C. | Partially OK | NG | NG | 34 μm | 29 μm | 5 μm |
| Ex. 7 | 235° C. | Partially OK | OK | NG | 29 μm | 15 μm | 14 μm |
| Ex. 8 | 240° C. | OK | OK | OK | 91 μm | 6 μm | 85 μm |
| Ex. 9 | 245° C. | OK | OK | OK | 44 μm | 11 μm | 33 μm |
| Ex. 10 | 250° C. | OK | OK | OK | 63 μm | 28 μm | 35 μm |
| Ex. 11 | 255° C. | OK | OK | OK | 72 μm | 14 μm | 58 μm |
| Ex. 12 | 260° C. | OK | OK | OK | 53 μm | 35 μm | 19 μm |

[Leak Test]

Similarly to the appearance observation, 80 sheets of the PTP sheets according to Examples 1 to 12 were manufactured also in a leak test. The leak test was performed under the condition 1 for 40 PTP sheets of the 80 PTP sheets and under the condition 2 for the remaining 40 sheets. Herein, under the condition 1, the leak test was performed in a usual PTP sheet state (State of FIG. 1). Under the condition 2, the leak test was performed in a state where the PTP sheet was separated along the slits to be divided into cells. The leak test was performed by disposing the PTP sheets in liquid, and then applying a negative pressure of 0.07 MPa to the PTP sheets. Then, it was confirmed whether or not liquid entered the space formed between the inside of the pockets of the PTP sheets and the second sheet.

The results are shown in Table 1 and Table 2 above. "OK" in "Leak (Condition 1)" and "Leak (Condition 2)" of Table 1 and Table 2 shows that liquid did not enter in all the PTP sheets and "NG" shows that liquid entered in at least one PTP sheet. In the case of Condition 1, it was confirmed from Table 1 and Table 2 that, when the temperature was 240° C. and the pressures were 0.15 MPa to 0.25 MPa and the pressure was 0.2 MPa and the temperatures were 235° C. to 260° C., liquid did not enter. In the case of Condition 2, it was confirmed that, when the temperature was 240° C. and the pressures were 0.2 MPa to 0.25 MPa and the pressure was 0.2 MPa and the temperatures were 240° C. to 260° C., liquid did not enter.

[Printing Accuracy Test]

A printing accuracy test was performed for Example 8 in which good results were obtained in the leak tests and the best result was obtained in the appearance observation and Comparative Examples 1 to 3.

The depth of the grooves of the second region of Example 8 is 6 μm and the depth of the grooves of the first region is 91 μm.

As Comparative Example 1, a PTP sheet was used which was a PTP sheet in which a resin film and aluminum foil were pasted to each other and in which a white colored layer was applied to the entire surface (surface on the aluminum foil side) opposite to the pockets formed in the resin film and grooves having a mesh shape and a depth of 33 μm were formed to the white colored layer side.

As Comparative Example 2, a PTP sheet was used which was a PTP sheet in which a resin film and aluminum foil were pasted to each other and in which a white colored layer was not formed on the surface (surface on the aluminum foil side) opposite to the pockets formed in the resin film and grooves having a mesh shape and a depth of 66 μm were formed to the surface described above.

As Comparative Example 3, a PTP sheet was used which was a PTP sheet in which a resin film and aluminum foil were pasted to each other and in which a white colored layer was applied to the entire surface (surface on the aluminum foil side) opposite to the pockets formed in the resin film and grooves having a mesh shape and a depth of 39 μm were formed to the white colored layer side.

In the printing accuracy test, a bar code was printed in the second region of Example 8 and on the surface on the aluminum foil side of Comparative Examples 1 to 3, and then a symbol contrast, a displacement width, and a flaw of the bar code were evaluated. Herein, the symbol contrast was evaluated based on whether or not the contrast between the printed bar code and the opposite surface was equal to or higher than a set value. The displacement width was evaluated based on whether the interval of each bar of the printed bar code deviated from a prescribed width. The flaw was evaluated based on the size of the ratio of a deleted portion in the printed bar code.

The evaluation results above are shown in Table 3. In Table 3, each of the symbol contrast, the displacement width, and the flaw was evaluated based on four grades with the highest evaluation A and the lowest evaluation D. Table 3 shows that Example 8 obtained the highest evaluation for the displacement width and the flaw. In Example 8, the evaluation of the symbol contrast was slightly inferior to the evaluation of Example 2 but, in Example 2, the evaluation of the displacement width and the flaw were inferior to not only the evaluation of Example 8 but the evaluation of Comparative Example 1. As described above, Example 8 was able to comprehensively obtain higher evaluation than the evaluation of Comparative Examples 1 to 3.

TABLE 3

| | Symbol contrast | Displacement width | Flaw |
|---|---|---|---|
| Ex. 8 | B | A | A |
| Comp. Ex. 1 | B | A | B |
| Comp. Ex. 2 | A | C | C |
| Comp. Ex. 3 | B | A | D |

DESCRIPTION OF THE REFERENCE NUMERAL

10 PTP sheet
11 solid pharmaceutical
14 first sheet
15 second sheet

16 pocket
31 upper surface of first sheet 14 (first surface)
32 lower surface of second sheet 15 (third surface)
35 lower surface of first sheet 14 (second surface)
36 upper surface of second sheet 15 (fourth surface)
41 first region
42 second region
43 third region
50 manufacturing apparatus
52 first conveyance unit
53 pocket formation unit
54 pharmaceutical loading unit
56 second conveyance unit
70 pasting unit
71 first roller

What is claimed is:

1. A PTP sheet for pharmaceutical packaging, comprising:
a first sheet that has a front surface and a back surface;
at least one pocket that projects from the back surface of the first sheet, is arranged to house a solid pharmaceutical, and has an opening on the first sheet; and
a second sheet that has a) a connecting side that is pasted to the front surface of the first sheet, covering the pockets, and b) an opposite side that has both a grooved region with mesh-shaped grooves and a relatively smooth region with either no grooves or grooves that have less depth than the grooves of the grooved region, the length and width of the relatively smoothed region exceeding the distance between adjacent grooves in the grooved region.

2. The PTP sheet for pharmaceutical packaging according to claim 1, wherein an entire edge of the opposite side of the second sheet defines a boundary of the grooved region.

3. The PTP sheet for pharmaceutical packaging according to claim 1, wherein the relatively smooth region of the opposite side of the second sheet includes portions of the opposite side of the second sheet that overlie the pockets.

4. The PTP sheet for pharmaceutical packaging according to claim 1, wherein a main component of the first sheet is a thermoplastic resin.

5. The PTP sheet for pharmaceutical packaging according to claim 1, wherein the second sheet is a laminated sheet having an aluminum layer.

6. The PTP sheet for pharmaceutical packaging according to claim 1, wherein:
a main component of the first sheet is a thermoplastic resin;
the second sheet is a laminated sheet having an aluminum layer; and
in the second relatively smooth region of the opposite side of the second sheet, a length along a longitudinal direction of the connecting side is longer than a length along a short direction of the connecting side.

7. The PTP sheet for pharmaceutical packaging according to claim 1, wherein a thickness of the first sheet is in a range of 200 μm to 350 μm.

8. The PTP sheet for pharmaceutical packaging according to claim 1, wherein a thickness of the second sheet is in a range of 20 μm to 25 μm.

9. The PTP sheet for pharmaceutical packaging according to claim 8, wherein the depth of any grooves in the relatively smooth region of the opposite side of the second sheet is 100 μm or less.

10. The PTP sheet for pharmaceutical packaging according to claim 1, wherein a marking field material that is suitable for carrying ink markings is adhered to the relatively smooth region.

11. The PTP sheet for pharmaceutical packaging according to claim 10, wherein the marking field material is white.

12. The PTP sheet for pharmaceutical packaging according to claim 11, wherein the marking field material is a coating that comprises titanium oxide.

13. The PTP sheet for pharmaceutical packaging according to claim 1, wherein an optically-readable code is printed in the relatively smooth region of the opposite surface of the second sheet.

14. A PTP sheet for pharmaceutical packaging, that comprises:
a first sheet that has a front and back surface;
at least one pocket that projects from the back surface of the first sheet, is arranged to house a solid pharmaceutical, and has an opening on the first sheet;
a second sheet that has a connecting side that is pasted to the front surface of the first sheet, covering the pockets;
a grooved region that is on an opposite side of the second sheet, has mesh-shaped grooves, and at least partially overlies the pockets, the portions of the grooved region that overlie the pockets being equal to or less than half of the total area of the connecting side that of the second sheet that overlies the pockets;
a relatively smooth region that is on the opposite side of the second sheet and has either no grooves or grooves that have less depth than the grooves of the grooved region.

* * * * *